US010624457B2

(12) United States Patent
Schmitz et al.

(10) Patent No.: US 10,624,457 B2
(45) Date of Patent: Apr. 21, 2020

(54) CHAIR

(71) Applicant: HERMAN MILLER, INC., Zeeland, MI (US)

(72) Inventors: Johann Burkhard Schmitz, Berlin (DE); Carola Zwick, Berlin (DE); Roland Zwick, Berlin (DE)

(73) Assignee: HERMAN MILLER, INC., Zeeland, MI (US)

( * ) Notice: Subject to any disclaimer, the term of this patent is extended or adjusted under 35 U.S.C. 154(b) by 2 days.

(21) Appl. No.: 16/082,464

(22) PCT Filed: Mar. 14, 2017

(86) PCT No.: PCT/EP2017/056001
§ 371 (c)(1),
(2) Date: Sep. 5, 2018

(87) PCT Pub. No.: WO2017/157943
PCT Pub. Date: Sep. 21, 2017

(65) Prior Publication Data

US 2019/0038033 A1 Feb. 7, 2019

(30) Foreign Application Priority Data

Mar. 14, 2016 (DE) ..... 10 2016 104 638

(51) Int. Cl.
*A47C 7/44* (2006.01)
*A47C 31/12* (2006.01)
(Continued)

(52) U.S. Cl.
CPC ..... *A47C 7/441* (2013.01); *A47C 3/026* (2013.01); *A47C 7/445* (2013.01); *A47C 31/126* (2013.01); *A47C 1/024* (2013.01)

(58) Field of Classification Search
CPC ..... A47C 1/03255; A47C 1/03277; A47C 31/126; A47C 7/445; A47C 1/03272; A47C 3/026
See application file for complete search history.

(56) References Cited

U.S. PATENT DOCUMENTS 2,818,911 A * 1/1958 Syak ..... A47C 7/445 248/575
3,369,840 A 2/1968 Dufton
(Continued)

FOREIGN PATENT DOCUMENTS

AU 783829 B2 4/2002
DE 3700447 A1 1/1987
(Continued)

OTHER PUBLICATIONS

International Search Report and Written Opinion for Application No. PCT/EP2016/055450 dated Oct. 5, 2016 (30 pages including English translation).
(Continued)

*Primary Examiner* — Shin H Kim
(74) *Attorney, Agent, or Firm* — Michael Best & Friedrich LLP

(57) ABSTRACT

The invention relates to a chair (1) which comprises a support (6), a seat element (5), a back element (4), a leg element (3), a spring mechanism and a weight-controlled working adjusting element for the spring mechanism.

10 Claims, 24 Drawing Sheets

(51) Int. Cl.
*A47C 3/026* (2006.01)
*A47C 1/024* (2006.01)

(56) References Cited

U.S. PATENT DOCUMENTS 4,077,596 A * 3/1978 Pinaire ..... A47C 3/026 248/575
4,387,876 A * 6/1983 Nathan ..... A47C 3/20 248/280.11
4,479,679 A * 10/1984 Fries ..... A47C 1/03255 297/300.5
4,653,806 A * 3/1987 Willi ..... A47C 1/03255 297/300.5
4,709,963 A * 12/1987 Uecker ..... A47C 1/03255 297/300.5
4,711,491 A * 12/1987 Ginat ..... A47C 3/026 297/300.5
4,761,033 A * 8/1988 Lanuzzi ..... A47C 1/03255 297/300.3
4,763,950 A * 8/1988 Tobler ..... A47C 1/03238 297/300.3
4,765,679 A 8/1988 Lanuzzi et al.
4,840,426 A * 6/1989 Vogtherr ..... A47C 1/03272 297/300.5
4,889,385 A * 12/1989 Chadwick ..... A47C 3/026 297/300.1
4,892,354 A * 1/1990 Estkowski ..... A47C 3/026 248/575
4,911,501 A 3/1990 Decker et al.
4,966,411 A * 10/1990 Katagiri ..... A47C 1/0325 297/300.3
5,029,940 A * 7/1991 Golynsky ..... A47C 3/026 297/300.4
5,056,866 A * 10/1991 Tobler ..... A47C 3/026 297/303.3
5,080,318 A 1/1992 Takamatsu et al.
5,224,758 A 7/1993 Takamatsu et al.
5,288,138 A * 2/1994 Stulik ..... A47C 1/03255 297/302.1
5,333,368 A * 8/1994 Kriener ..... A47C 1/024 297/302.1
5,348,372 A 9/1994 Takamatsu et al.
5,375,912 A * 12/1994 Stulik ..... A47C 3/026 297/302.4
5,397,165 A * 3/1995 Grin ..... A47C 1/03255 297/300.5
5,486,035 A * 1/1996 Koepke ..... A47C 1/03255 297/300.1
5,511,759 A * 4/1996 DeKraker ..... A47C 3/30 248/161
5,547,252 A * 8/1996 Pfenniger ..... A47C 1/03255 297/300.3
5,551,674 A * 9/1996 Johnsen ..... B60G 17/021 267/168
5,658,045 A * 8/1997 Van Koolwijk ... A47C 1/03255 297/300.5
5,660,439 A * 8/1997 Unwalla ..... A47C 1/03255 297/300.2
5,765,914 A * 6/1998 Britain ..... A47C 1/03238 297/300.4
5,806,930 A * 9/1998 Knoblock ..... A47C 1/03255 297/284.11
5,909,924 A * 6/1999 Roslund, Jr. ..... A47C 1/03255 297/300.4
5,909,974 A * 6/1999 Myung ..... B41J 19/142 400/283
5,918,935 A * 7/1999 Stulik ..... A47C 1/03255 248/597
5,979,984 A * 11/1999 DeKraker ..... A47C 1/023 297/300.5
6,085,153 A * 7/2000 Hirsh ..... G01J 3/28 356/326
6,250,715 B1 6/2001 Caruso et al.
6,582,019 B2 * 6/2003 Insalaco ..... A47C 1/03255 297/300.1
7,036,882 B2 * 5/2006 Elzenbeck ..... A47C 1/03255 297/300.1
7,273,253 B2 9/2007 Deimen et al.
7,513,569 B2 4/2009 Curiger
7,600,814 B2 * 10/2009 Link ..... A47C 1/03255 297/300.2
7,625,045 B2 12/2009 Hatcher et al.
7,784,870 B2 8/2010 Machael et al.
7,857,390 B2 * 12/2010 Schmitz ..... A47C 1/03255 297/300.1
7,992,937 B2 * 8/2011 Plikat ..... A47C 1/03255 297/300.2
8,025,334 B2 * 9/2011 Schmitz ..... A47C 1/03255 297/300.1
8,146,990 B2 4/2012 Bock
8,967,724 B2 * 3/2015 Battey ..... A47C 1/032 297/411.35
9,560,917 B2 * 2/2017 Roslund, Jr. ..... A47C 7/44
9,801,471 B2 * 10/2017 Machael ..... A47C 1/03255
9,839,292 B2 * 12/2017 Miller ..... A47C 1/03255
9,867,468 B2 * 1/2018 Wu ..... A47C 3/18
10,021,979 B2 * 7/2018 Miller ..... A47C 1/0347
10,213,021 B2 * 2/2019 Walters ..... A47C 1/06
10,238,215 B2 * 3/2019 Peterson ..... A47C 31/023
10,321,763 B2 * 6/2019 Bonneywell ..... A47C 1/024
10,383,448 B1 * 8/2019 VerBeek ..... A47C 7/563
10,485,346 B2 * 11/2019 Jones ..... A47C 1/03238
2002/0109384 A1 * 8/2002 Hansen ..... A47C 1/03255 297/300.1
2003/0137171 A1 * 7/2003 Deimen ..... A47C 3/18 297/284.1
2004/0195883 A1 * 10/2004 Vrijlandt ..... A47C 1/03255 297/302.4
2004/0245827 A1 * 12/2004 Bedford ..... A47C 7/28 297/300.1
2006/0006715 A1 1/2006 Chadwick et al.
2006/0202530 A1 9/2006 Lin
2008/0088163 A1 4/2008 Sander et al.
2009/0079238 A1 3/2009 Plikat et al.
2009/0146476 A1 6/2009 Kan et al.
2009/0261637 A1 10/2009 Schmitz et al.
2010/0141002 A1 6/2010 Kurrasch et al.
2012/0002557 A1 1/2012 Sedler et al.
2013/0169017 A1 7/2013 Masunaga et al.
2015/0123441 A1 5/2015 Duke
2016/0100691 A1 4/2016 Masunaga et al.
2016/0227935 A1 8/2016 DeJule et al.
2019/0038033 A1 2/2019 Schmitz et al.

FOREIGN PATENT DOCUMENTS

DE 4208648 C1 5/1993
DE 102013005861 A1 10/2014
WO 2007110732 A2 10/2007
WO 2016146582 A2 9/2016

OTHER PUBLICATIONS

International Search Report and Written Opinion for Application No. PCT/EP2017/056001 dated May 31, 2017 (16 pages including English translation).
Examination Report issued from the Australian Patent Office for related Application No. 2016232337 dated Nov. 27, 2019 (3 pages).

* cited by examiner

CHAIR

BACKGROUND

The invention relates to a chair having a support, a seat element, a back element, a foot element, a spring mechanism, and a weight-control-operated adjustment installation for the spring mechanism. The spring mechanism comprises at least one leaf spring and a bearing that is displaceable on a raceway between the leaf spring and the support. The back element is supported on a free end region of the leaf spring. The adjustment installation comprises an actuator, a transmission means, and a weighing mechanism that guides the actuator.

SUMMARY

A chair which comprises a support, a seat element, a back element, a foot element, a spring mechanism, and a weight-control-operated adjustment installation for the spring mechanism, wherein the spring mechanism comprises at least one leaf spring that on one side is clamped in the support, and at least one bearing that is displaceable on a runway between at least one of the leaf springs and the support, wherein the back element and/or the seat element are/is supported on a free end region of the at least one leaf spring, and wherein the adjustment installation comprises an actuator, a transmission means, and a weighing mechanism that guides the actuator, is known from WO 2007/110732 A2.

The invention is based on the object of developing a chair in which a weight-control-operated adjustment installation is constructed so as to be compact and flat such that said adjustment installation can be accommodated in an optimal manner below a seat face of a chair. It is furthermore an object of the invention to ensure by way of the adjustment installation that any readjustment of a set supporting force is avoided even in the case of the back element being completely reclined.

This object, proceeding from the features of the preamble of claim 1, is achieved by the characterizing features of claim 1. Advantageous and expedient refinements are set forth in the dependent claims.

In the case of the chair according to the invention

- the actuator comprises a gear wheel, and the actuator in the stressing and the de-stressing of the seat element is displaced by the weighing mechanism on a rack that is disposed in a locationally fixed manner on the foot element and herein rolls on said rack,
- wherein the transmission means comprises a knuckle joint lever,
- wherein the knuckle joint lever comprises a first leg and a second leg,
- wherein the first leg is connected in a rotationally fixed manner to the gear wheel,
- wherein the first leg and the second leg in an articulation point are interconnected so as to be rotated in an articulated manner about an articulation axis,
- wherein the second leg is connected to the bearing,
- wherein the bearing, depending on a rotary position of the gear wheel between a first, forward position and a third, rearward position, is positioned below the at least one leaf spring such that said leaf spring, depending on the respective position of the bearing, supports the back element to a variable degree.

On account of the adjustment installation being equipped with the first leg which is connected in a rotationally fixed manner to the gear wheel and on which the second leg is disposed in a rotationally articulated manner, a type of thrust crank mechanism by way of which a compact and flat construction of the adjustment installation is possible is formed.

In order for an undesirable repositioning of the bearing to be avoided it is also provided that the leaf spring in the case of a completely tilted-back back element by way of a force slides the bearing from the third, rearward position thereof in the direction of the first, forward position of said bearing such that by way of the first and of the second leg a torque acts on the first gear wheel of the actuator, wherein said torque, by way of a position of the legs assumed by the latter in the rearward, third position of the bearing, is kept low in such a manner that any rotation of the first gear wheel is prevented on account of the weight-controlled weighing mechanism. In the case of an adjustment installation conceived in such a manner, a repositioning of the bearing by completely tilting back the back element is reliably avoided such that the pre-adjustment of the supporting force determined by the weighing mechanism is maintained as long as a person is seated on the chair.

It is provided that the two legs in the rearward, third position of the bearing conjointly are at an angle <30°. It is prevented on account thereof that the leg that is connected to the bearing can generate an excessive torque acting on the gear wheel.

It is also provided that the first leg in the rearward, third position of the bearing is at an angle of at least 130° in relation to a movement direction of the bearing. It is also prevented on account thereof that an excessive torque acting on the gear wheel can be generated.

It is furthermore provided that the first leg is shorter than the second leg, and that the first leg has a length which is at most half a length of the second leg. On account thereof, a space which the knuckle joint formed by the legs in the movement thereof requires is kept small in terms of height, on the one hand, on account thereof a lever length, by way of which the second leg that is connected to the bearing can act on the gear wheel, being kept small, on the other hand.

It is also provided that the transmission means comprises a second gear wheel and a rack that is configured so as to be locationally fixed on the support,

- wherein the second gear wheel is connected to a free end of the second leg so as to be rotatable about a rotation axis,
- wherein the second gear wheel in a rotating movement of the first gear wheel rolls on the rack that is configured on the support, and
- wherein the second gear wheel is connected to the bearing in such a manner that said gear wheel engages in a denticulation that is configured on the bearing such that the bearing in the rolling of the gear wheel is displaced with the gear wheel on the rack that is configured on the support and displaced relative to the gear wheel. On account of an indirect coupling of this type of the second lever to the bearing a particularly smooth movement of the bearing is achieved, since the latter is moved by the second lever by means of an intervening rotating gear wheel.

It is also provided that the chair comprises an articulation means and a weighing spring, wherein the foot element and the support are connected by the articulation means, and wherein the support is supported on the foot element by way of the weighing spring. On account thereof, the weight of a person taking a seat on the seat face of the chair can be readily and rapidly detected by the dimensions by which the support moves, or sinks, respectively, counter to the force of the weighing spring and relative to the foot element of the chair.

The back element and the seat element conjointly form a seat shell. On account thereof, it is also possible for the back element, with the intervention of the seat element, to be supported on the leaf spring that is influenced by the bearing.

It is also provided that the chair is equipped with a front swing arm and a rear swing arm, wherein the front swing arm is pivotably articulated on the support and is connected to the seat element, wherein the rear swing arm is pivotably articulated on the support and is connected to the seat shell. On account thereof, the seat shell, or the seat element and the back element, respectively, is/are imparted the degrees of freedom required for the respective movement thereof.

It is furthermore provided that the leaf spring, or the leaf springs, respectively, is/are in each case fixed to the support by a first end region, in each case bearing on the bearing or the bearings, respectively, outside the first end region, and in each case supporting the seat shell outside the first end region. On account thereof, an adjustment of the spring force by way of which the leaf spring, or the leaf springs, respectively supports/support the seat shell is possible by a repositioning of the bearing.

A seat shell in the context of the invention comprises a seat element and a back element. It is provided herein for the seat shell to be configured in an integral manner such that the seat element is connected to the back element by way of a connection means such as, in particular, at least one connection joint or at least one elastic connection element, as well as for the seat element and the back element to be interconnected only indirectly by way of the mechanical assembly.

Further details of the invention will be described in the drawing by means of schematically illustrated exemplary embodiments.

BRIEF DESCRIPTION OF THE DRAWINGS

In the drawing:

A chair 1 according to the invention having a mechanical assembly 2 is illustrated in a perspective side view in FIG. 1. FIG. 2 shows the mechanical assembly 2. FIG. 3 shows the chair 1 which is illustrated in FIG. 1 in a side view from the right, and FIG. 4 shows the mechanical assembly 2 again in an enlarged illustration, but in the side view corresponding to FIG. 3. The mechanical assembly 2 which is known from FIGS. 1 to 4 is illustrated in FIGS. 5 to 19 in further views, wherein to some extent components have been disregarded in order to improve the illustration of individual components.

Figure 1:
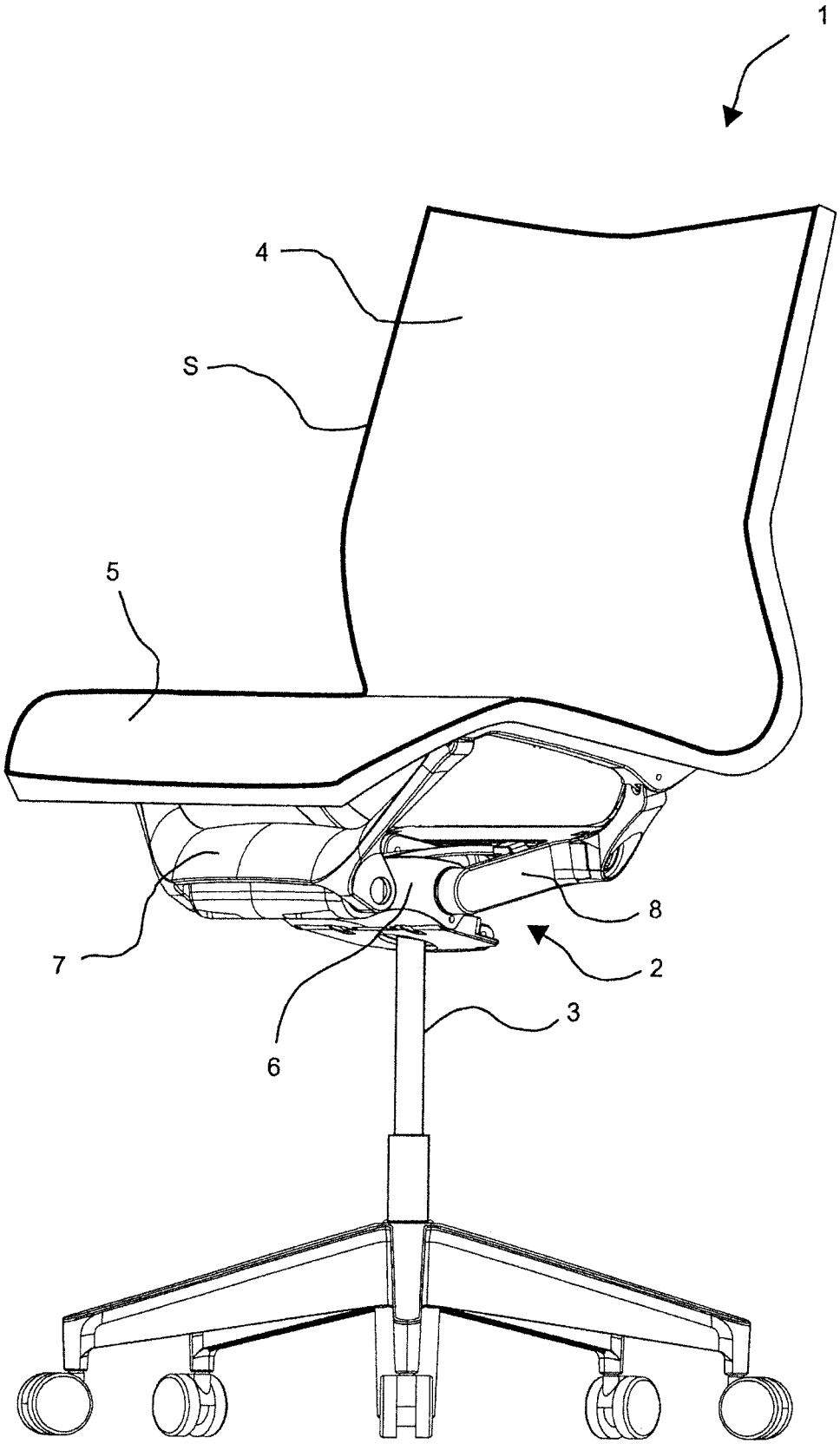
FIG. 1 shows a perspective side view of a chair according to the invention, having a mechanical assembly according to the invention.
Figure 2:
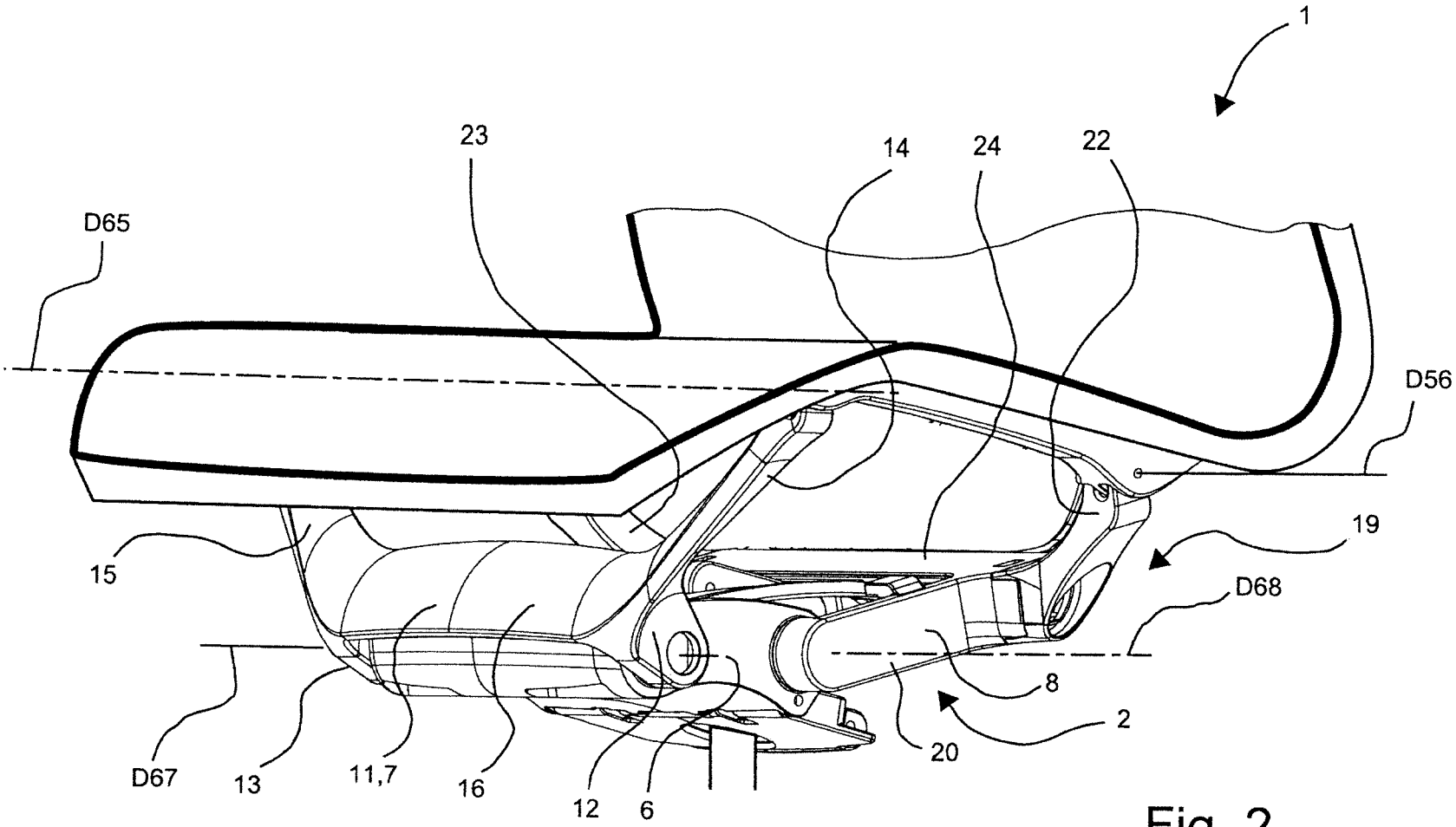
FIG. 2 shows a detailed view of FIG. 1.
Figure 3:
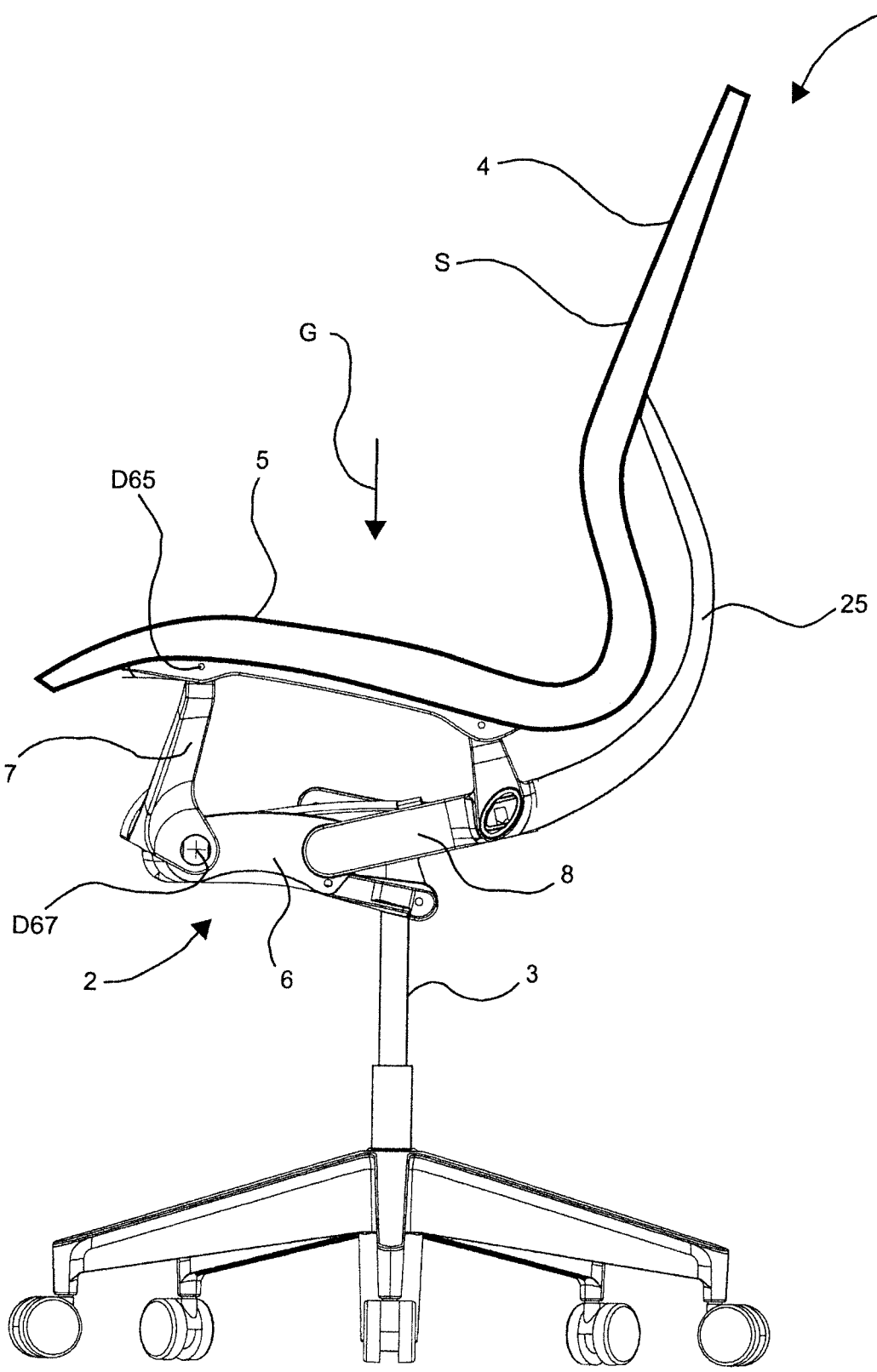
FIG. 3 shows a side view of FIG. 1.
Figure 4:
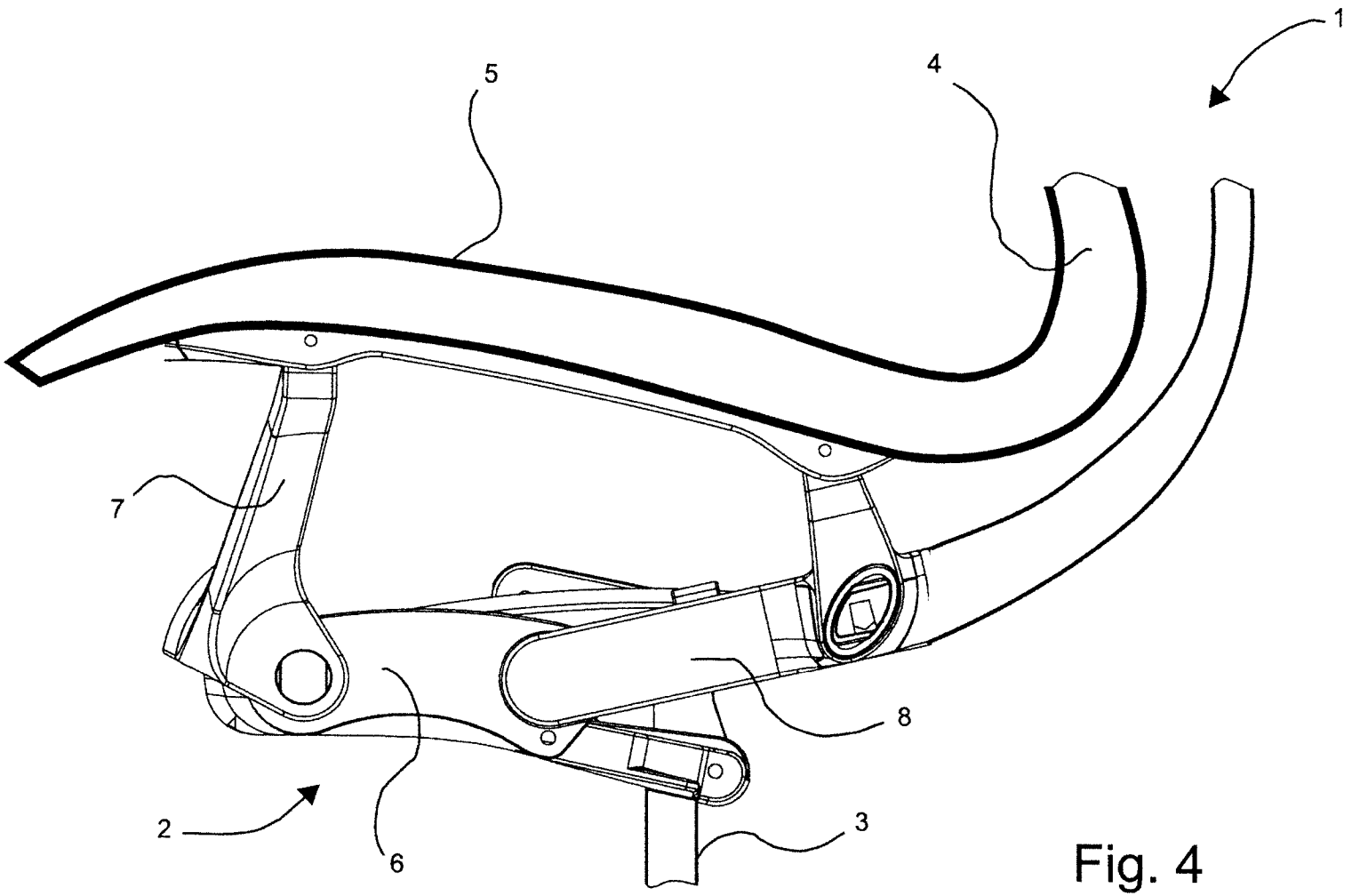
FIG. 4 shows a detailed view of FIG. 3.
Figure 5:
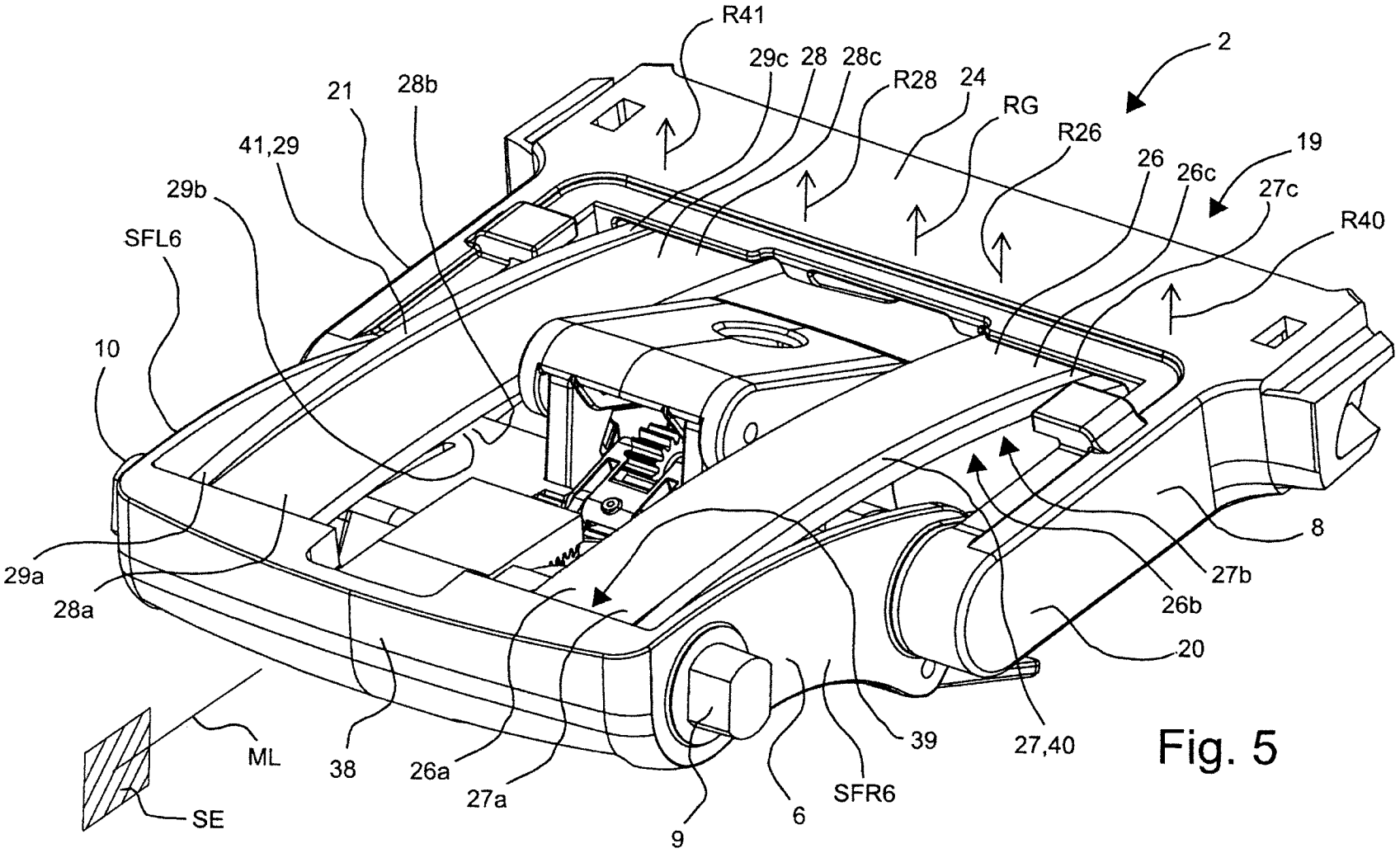
FIG. 5 shows a perspective view of the mechanical assembly of the chair.

As is shown in particular in FIGS. 1 to 6, a foot element 3, a back element 4, and a seat element 5 are articulatable on the mechanical assembly 2 for the chair 1. Here, the back element 4 and the seat element 5 form a seat shell S. The mechanical assembly 2 comprises a support 6, a front swing arm 7, which is shown only in FIGS. 1 to 4, and a rear swing arm 8 which, commencing from FIG. 5, is illustrated at best in a cut-off manner.

The front swing arm 7 is articulated on the support 6 so as to be pivotable about a rotation axis D67 and is connected to the seat element 5 so as to be pivotable about a rotation axis D65, wherein to this end axle journals 9, 10 are configured on the support 6, on a right side wall SFR6 of the support 6 and on a left side wall SFL6 of the support 6, into which axle journals 9, 10 the front swing arm 7 is dropped (cf. FIGS. 1 to 4, for example). The front swing arm 7 is configured as an H-type bracket 11 (see in particular FIG. 2) which comprises four legs 12, 13, 14, and 15, and a cross brace 16. Here, the first and the second legs 12, 13 are connected to the support 6, and the legs 14, 15 here are connected to the seat element 5.

The rear swing arm 8 (see in particular FIG. 2) is articulated on the support 6 so as to be pivotable about a rotation axis D68 and is connected to the seat shell S, wherein the support 6 is connected to the seat element 5 so as to be pivotable about a rotation axis D56. To this end, axle journals 17, 18 are configured on the support 6, on the right side wall SFR6 of the support 6 and on the left side wall SFL6 of the support 6 (see FIG. 6), into which axle journals 17, 18 the rear swing arm 8 is dropped. The rear swing arm 8, like the front swing arm 7, is configured as an H-type bracket 19 (see FIGS. 2 and 5) which comprises four legs 20, 21, 22, and 23, a cross brace 24, and an appendage 25 (see FIG. 3). Here the first and the second legs 20, 21 are connected to the support 6, the legs 22, 23 here are connected to the seat element 5, and the appendage 25 here is connected to the back element 4, such that the rear swing arm 8 is connected to both the seat element 5 and the back element 4.

In order for a body weight G of a person (not illustrated) seated on the chair 1 to be compensated for, the mechanical assembly 2 comprises four leaf springs 26, 27, 28, and 29. Here, the internal leaf springs 26 and 28 which are close to a central longitudinal axis ML are configured as wide leaf springs, and the leaf springs 27 and 29 which are remote from the central longitudinal axis ML are configured as narrow leaf springs (see FIG. 5). It can be seen from FIG. 6 that in each case one contact area 31, 32 which is configured on the support 6 is assigned to the narrow leaf springs 27 and 29 on a base 30 of the support 6. On account thereof, the restoring force of the narrow leaf springs 27 and 29 is defined to a fixed value.

Figure 17:
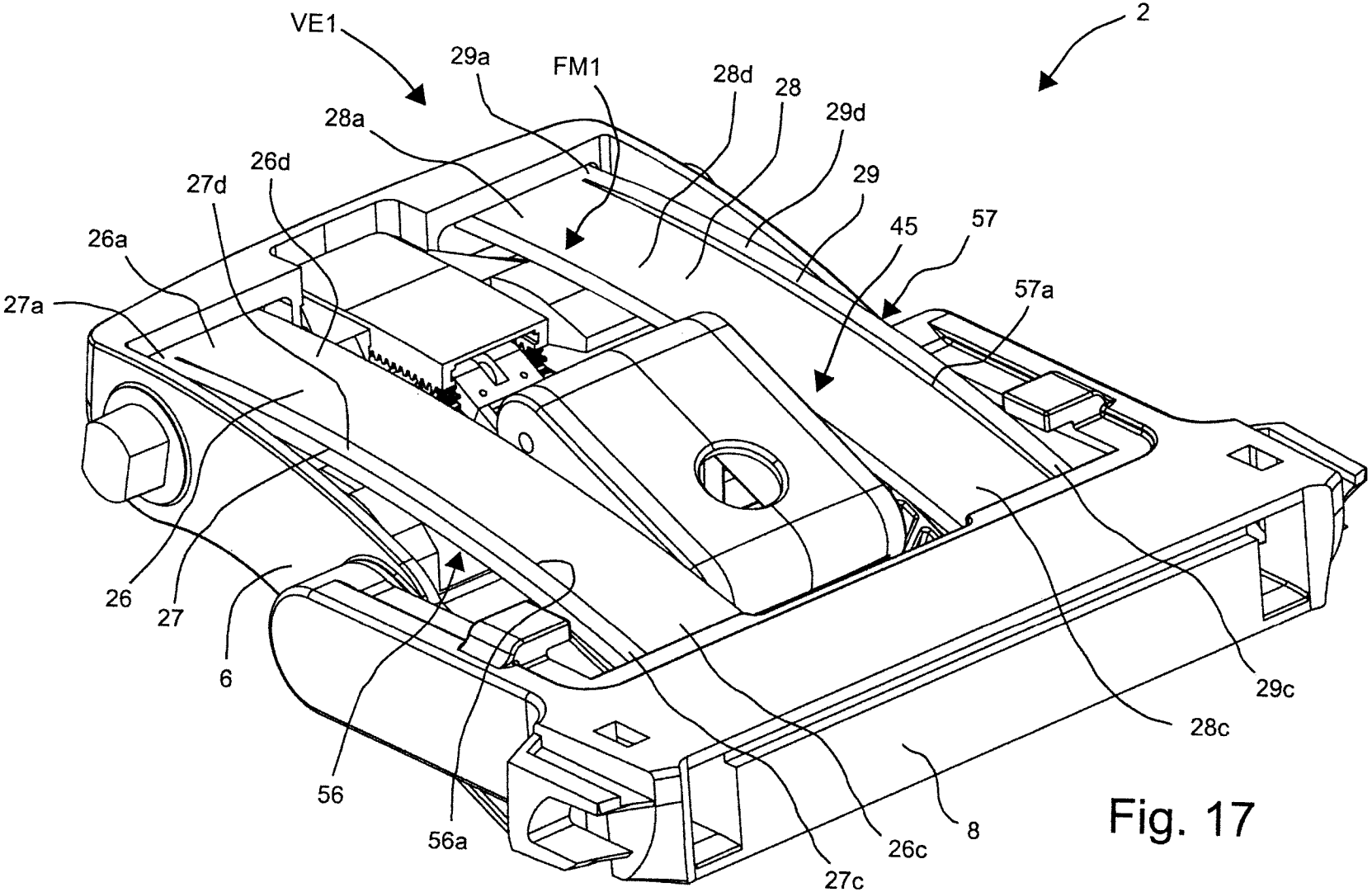
FIG. 17 shows a further perspective illustration of the mechanical assembly.
Figure 18:
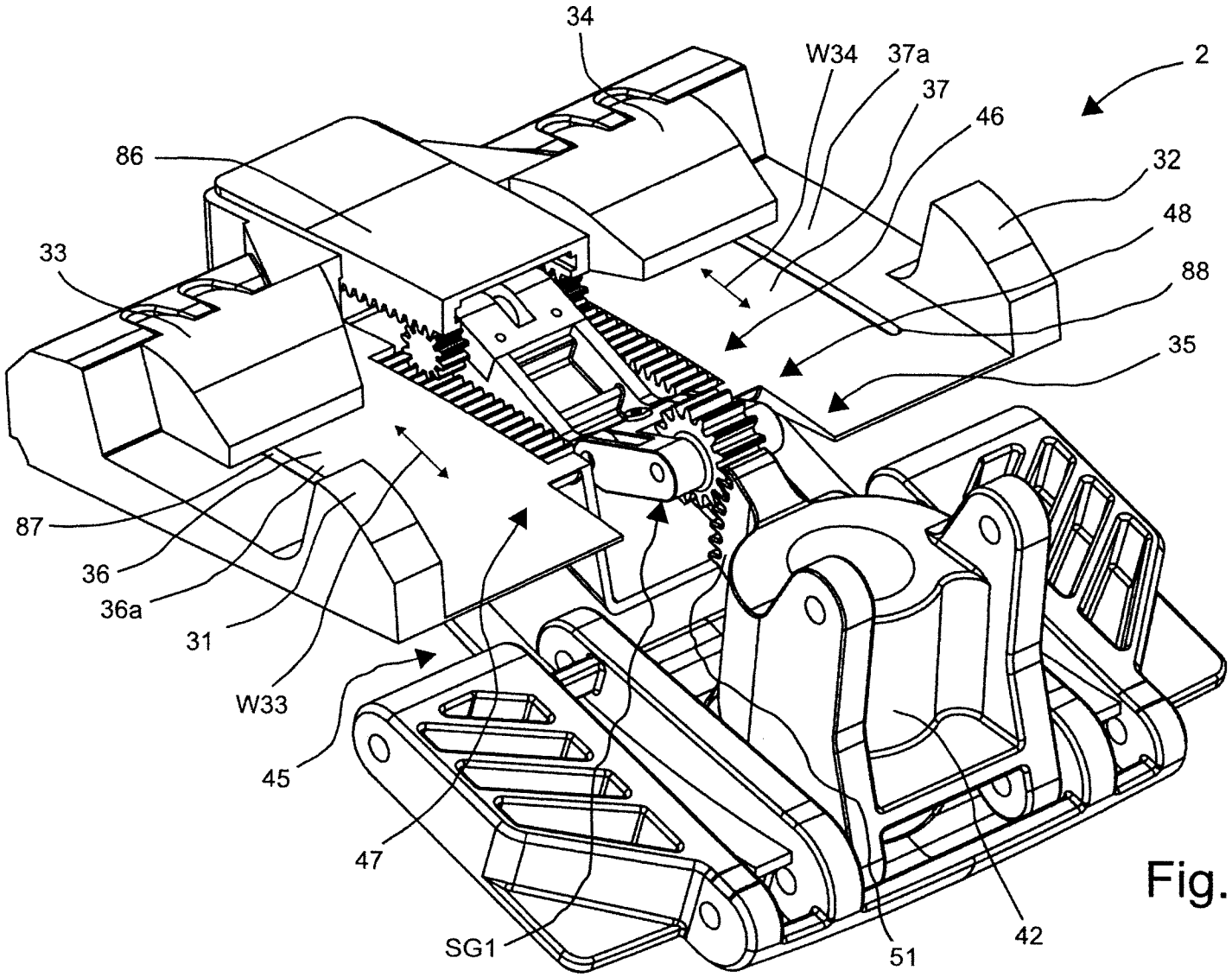
FIGS. 18 and 19 show the illustration of FIG. 17, with partially disregarded components.
Figure 20:
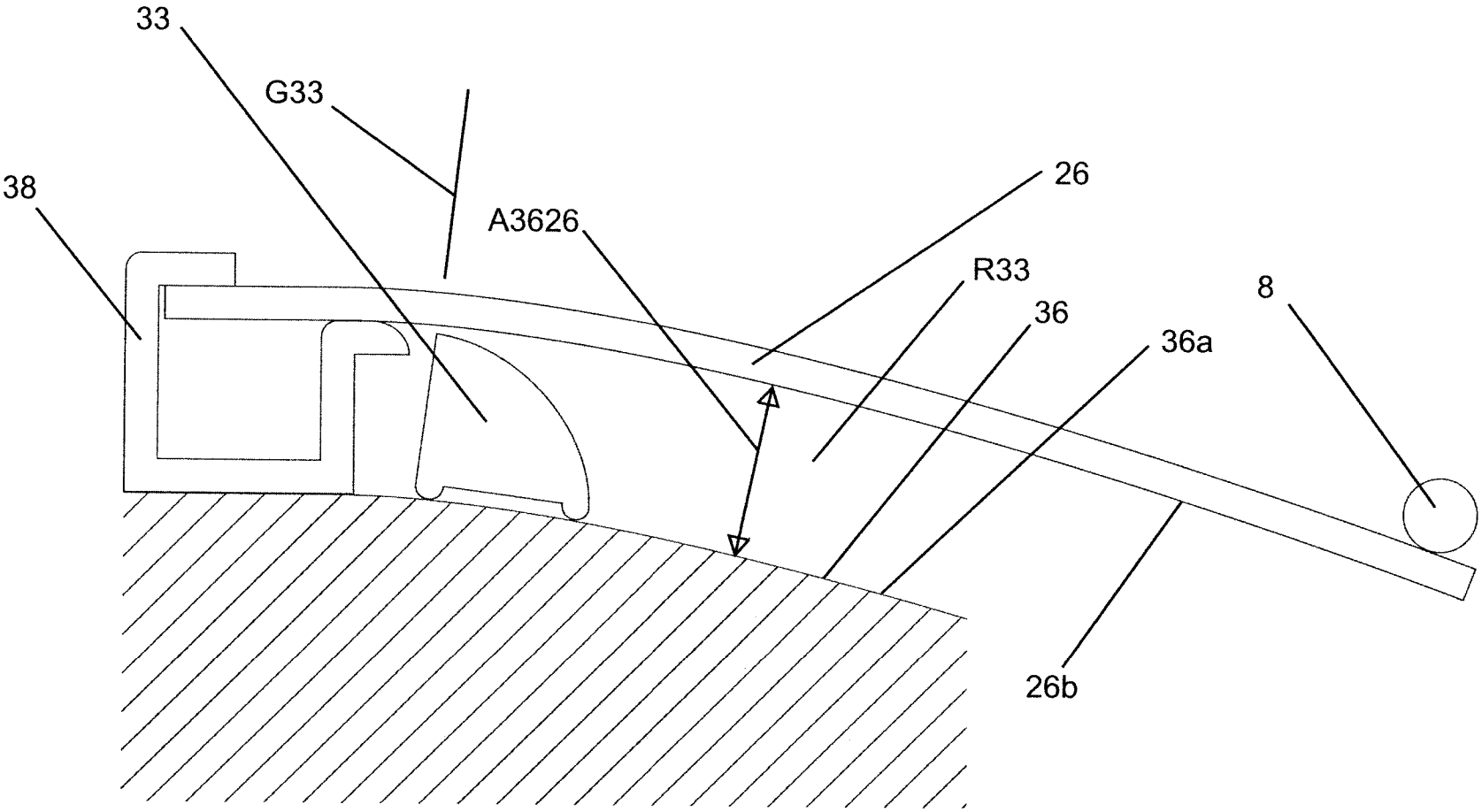
FIGS. 20, 21 show schematic illustrations for further explaining the first variant of embodiment shown in FIGS. 1 to 19.
Figure 21:
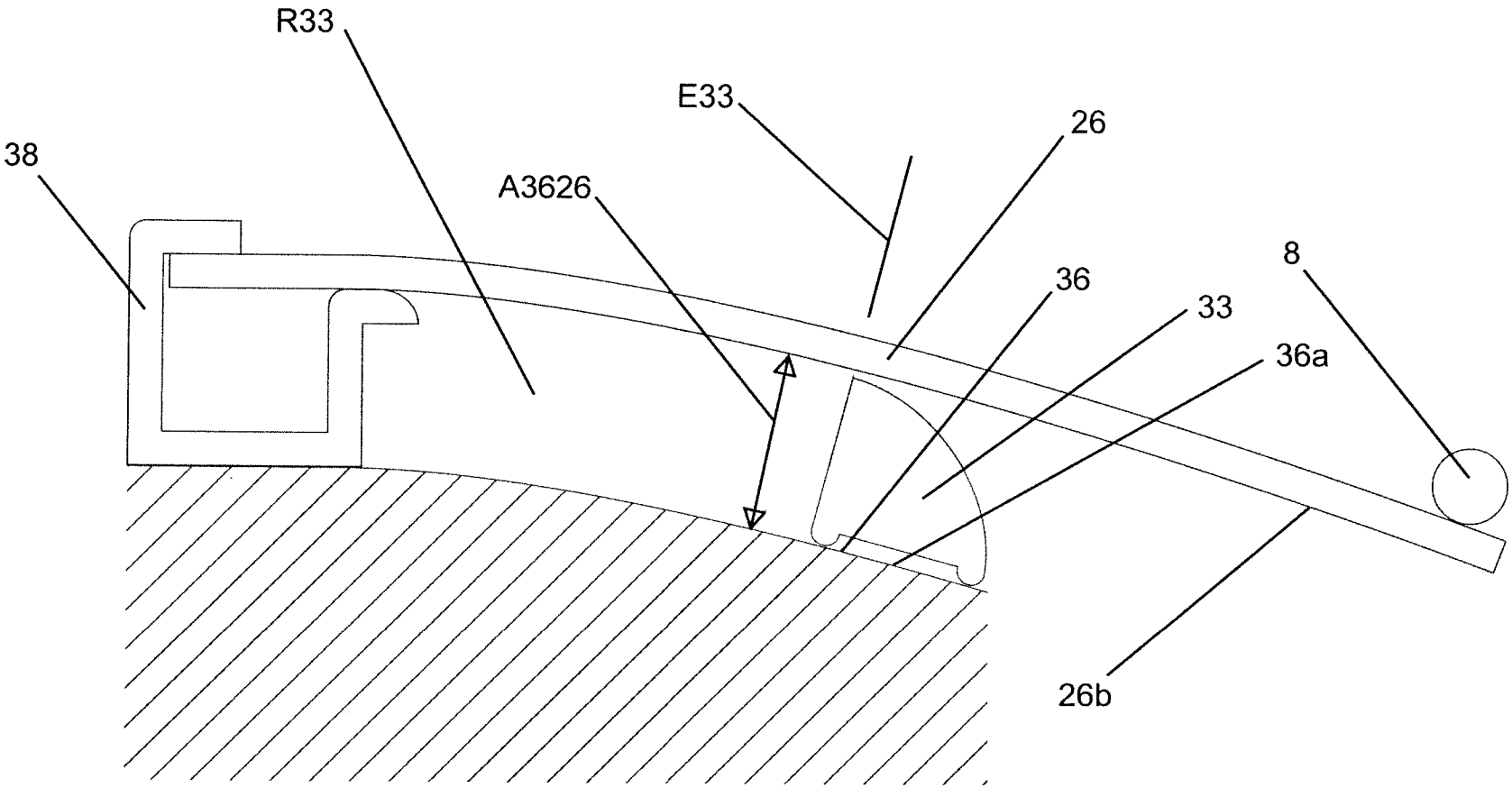

The mechanical assembly 2 comprises two adjustable bearings 33, 34, an adjustment mechanism 35 for the bearings 33, 34, and raceways 36, 37 for the bearings 33, 34 (see in particular FIG. 18). The bearings 33, 34 are interconnected while configuring a web 86 and are guided into two parallel-running guides 87, 88 (see FIG. 18). On account thereof, canting during a displacement movement is effectively precluded. The raceways 36, 37 are configured as faces 36*a*, 37*a* that are curved in the direction of the leaf springs 26 or 28, respectively. The curvature of the raceways 36 or 37, respectively, herein is adapted to the curvature which the leaf springs 26 or 28, respectively, by way of the lower side 26*b* or 28*b*, respectively, thereof have when the back element 4 is in an upright position that is unstressed by a user in such a manner that a spacing A3626 (see FIG. 20) that is measured so as to be radial to the raceway 36 or 37, respectively, in the entire moving space R33 of the bearing 33 is always approximately consistent and always of such a size that the bearing 33 or 34, respectively, can be displaced in an unimpeded manner on the raceway 36 or 37, respectively, by the leaf spring 26 or 28, respectively. To this end, reference is made to FIGS. 17 and 18 and to the diagrammatic and purely schematic FIGS. 20 and 21. The latter show a bulkhead 38, the leaf spring 26 that is fastened to the bulkhead 38, and the raceway 36. The rear swing arm 8 which is supported on the leaf spring 26 is furthermore indicated by a circle. The bearing 33 in the illustration of FIG. 20 is in a basic position G33, the former assuming said basic position G33 when the chair is unstressed. The bearing 33 in the illustration of FIG. 21 is in a terminal position E33, the former assuming said terminal position E33 when the chair is stressed by a heavy person.

Both the internal leaf springs 26, 28 as well as the external leaf springs 27, 29 (see FIG. 5) by way of a first end region 26*a*, 27*a*, 28*a*, 29*a* are fixed to the support 6 in a receptacle 39 on the bulkhead 38 which is disposed between the axle journals 9, 10.

Outside their end regions 26*a*, 27*a*, 28*a*, 29*a* the leaf springs 26, 27, 28, and 29 bear in each case by way of a lower side 26*b*, 27*b*, 28*b*, 29*b* on the respectively assigned bearing 33, 31, 34, 32 and by way of opposite end regions 26*c*, 27*c*, 28*c*, 29*c* indirectly support the seat shell S or directly support the rear swing arm 8 on the cross brace 24 thereof (see FIG. 5).

The external leaf springs 27, 29 of the mechanical assembly 2 form further spring elements 40, 41. Here, the elastic restoring force R40, R41 of the two further spring elements 40, 41, and the elastic restoring force R26, R28 of the two internal leaf springs 26, 28, add up to a total restoring force RG which by way of the swing arm 8 supports the seat shell S.

Figure 6:
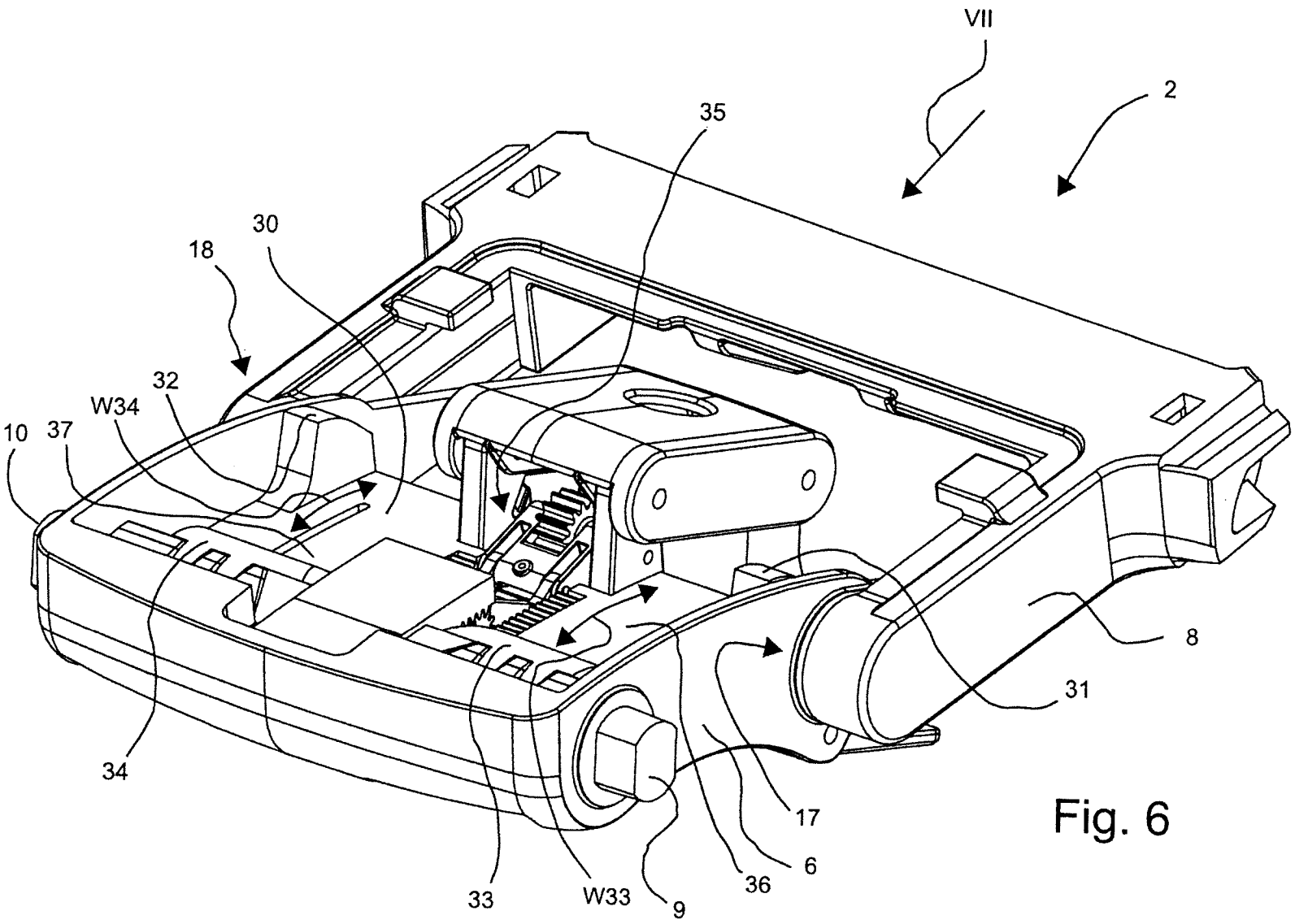
FIG. 6 shows the illustration of FIG. 5, with the leaf springs disregarded.
Figure 7:
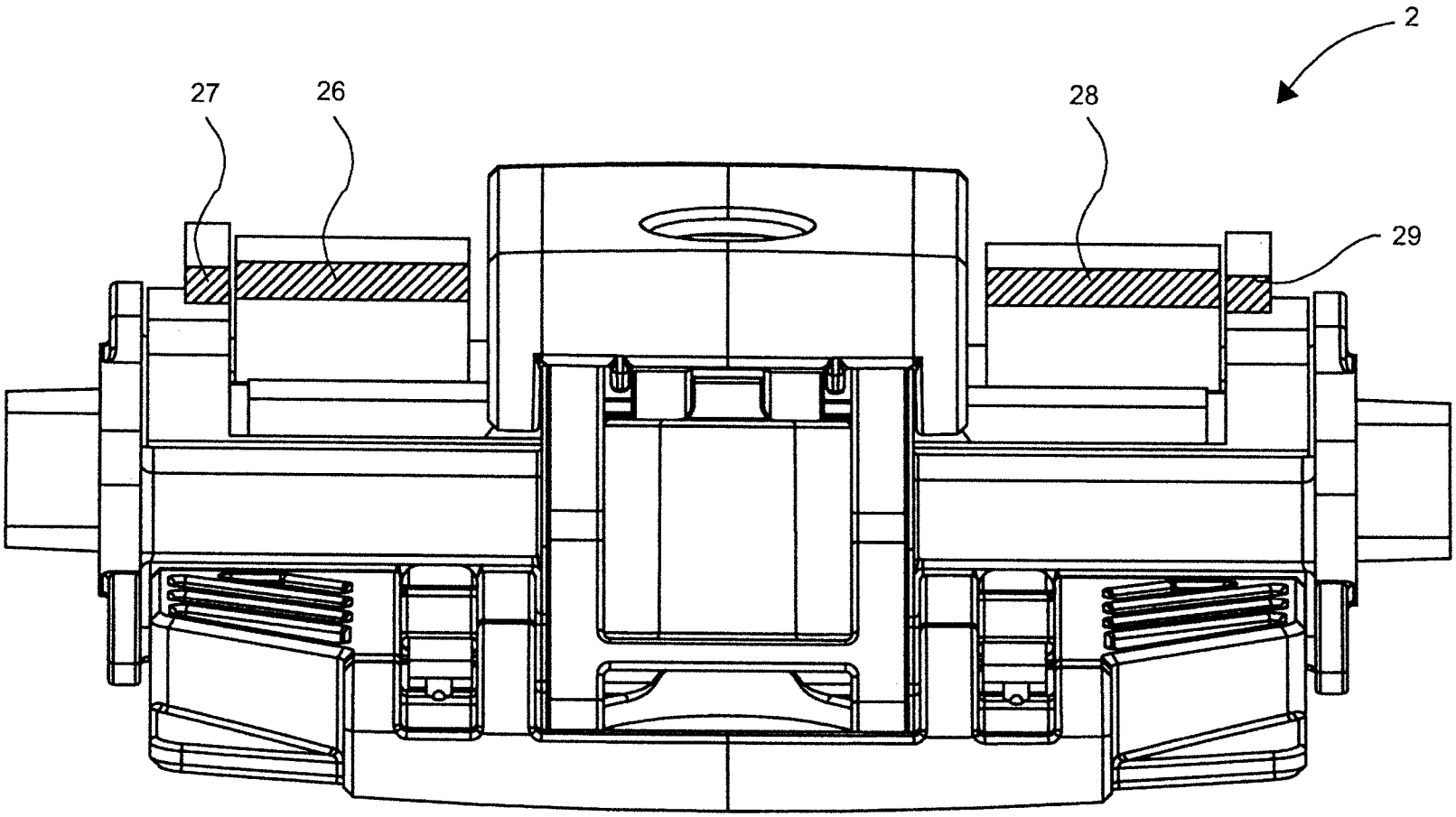
FIG. 7 shows a side view of FIG. 6, corresponding to the direction of the arrow VII shown therein.
Figure 8:
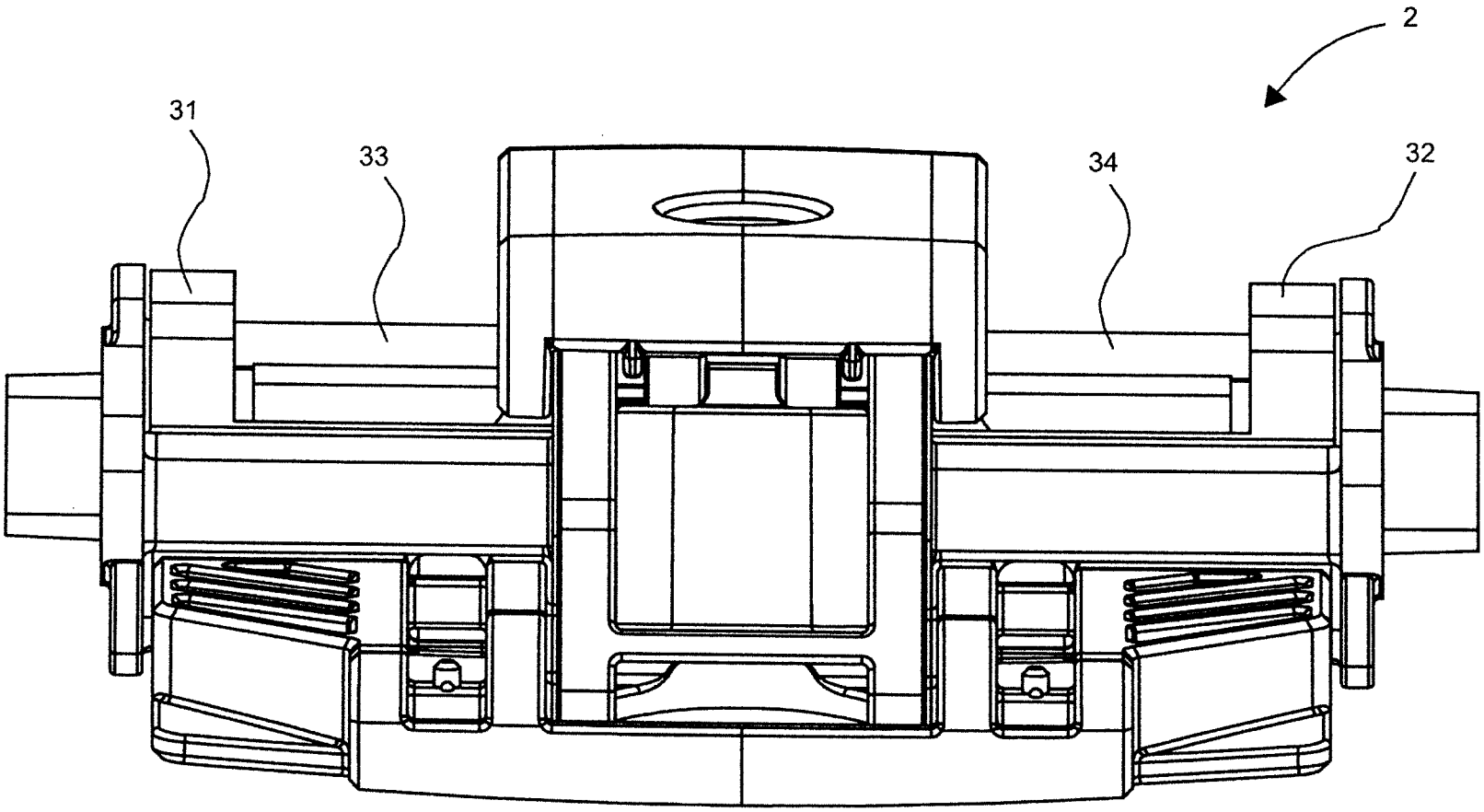
FIG. 8 shows the illustration of FIG. 7, with the leaf springs disregarded.

The two internal leaf springs 26, 28 of the mechanical assembly 2 are assigned to the displaceable bearings 33, 34, wherein each bearing 33, 34 is assigned to one of the leaf springs 26, 28, and wherein the bearings 33, 34 are displaceable below the leaf springs 26, 28 by the adjustment mechanism 35, and are displaceable thereby in each case on their raceways 36, 37 by identical paths W33, W34 (see FIG. 6).

Figure 9:
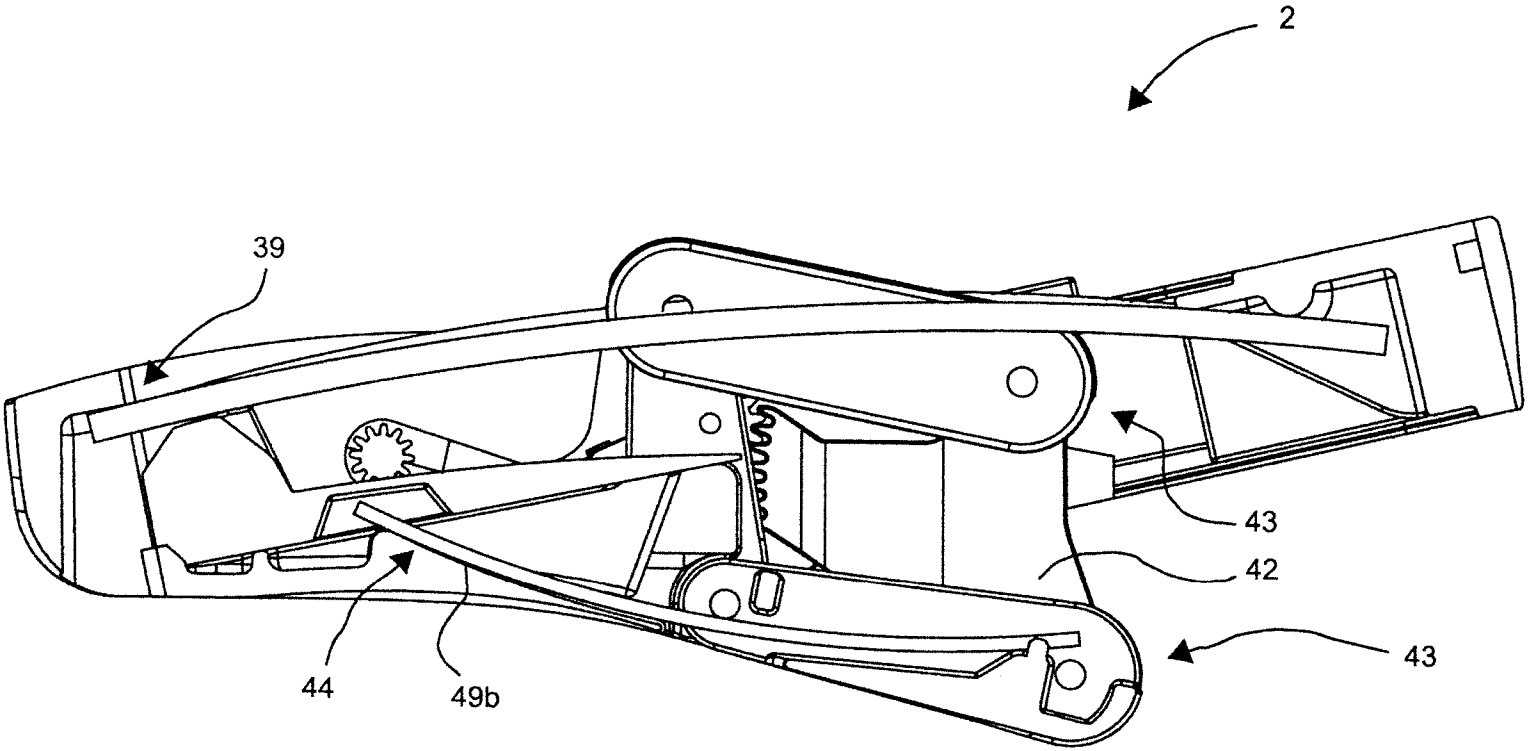
FIG. 9 shows a sectional side view of the mechanical assembly.
Figure 10:
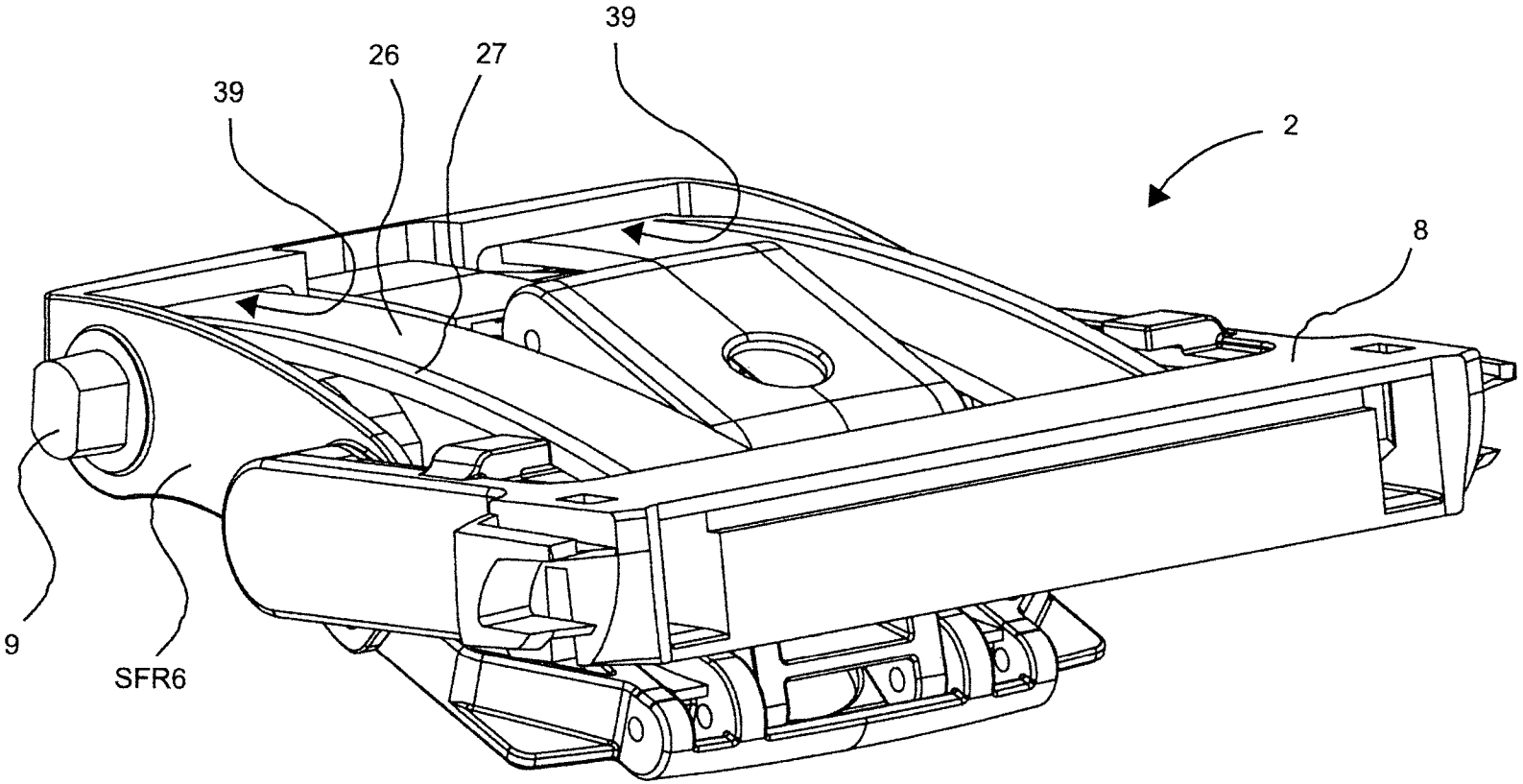
FIG. 10 shows a further perspective view of the mechanical assembly.
Figure 11:
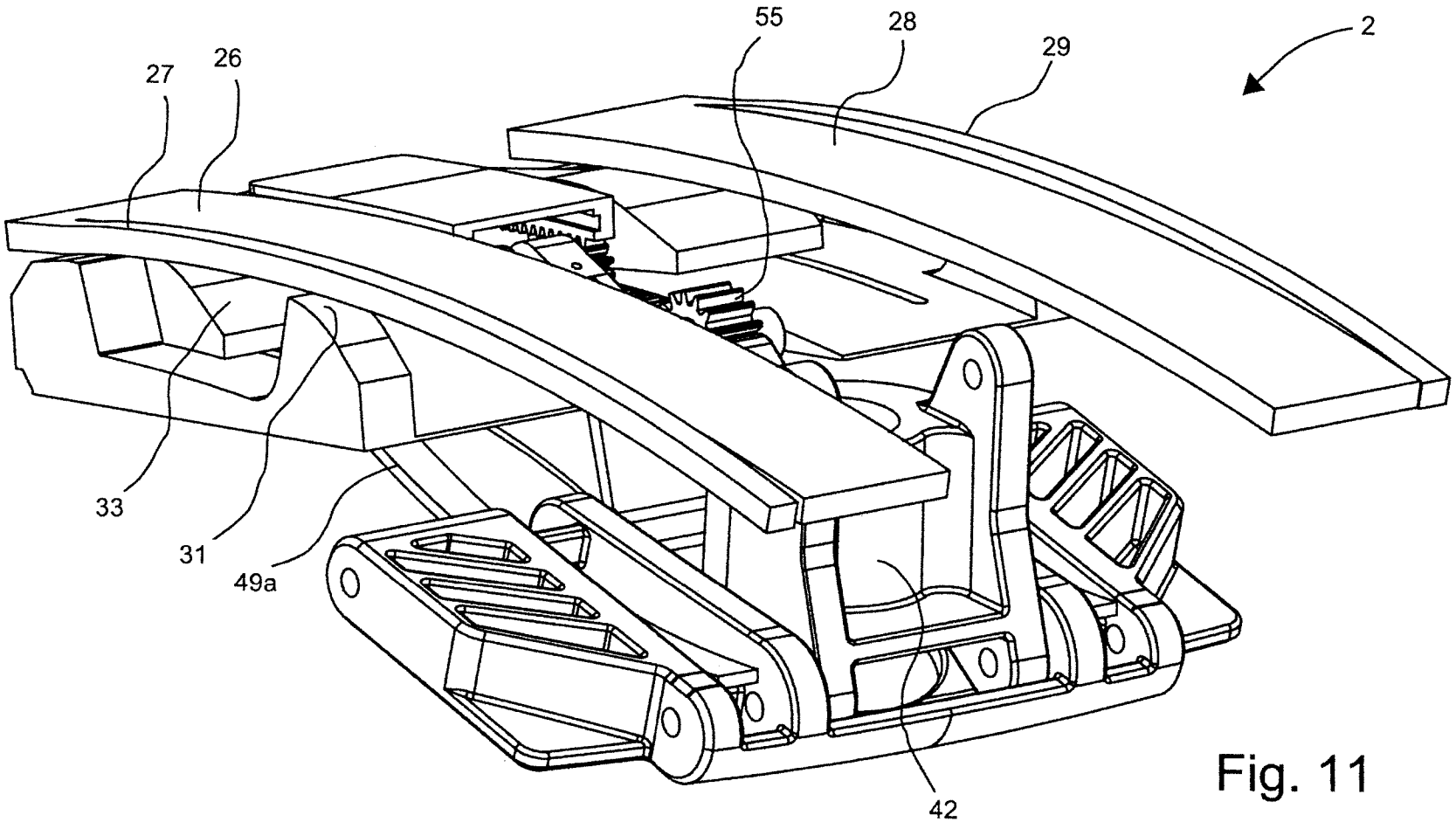
FIG. 11 shows the illustration of FIG. 10, with the support disregarded and the rear swing arm disregarded.
Figure 19:
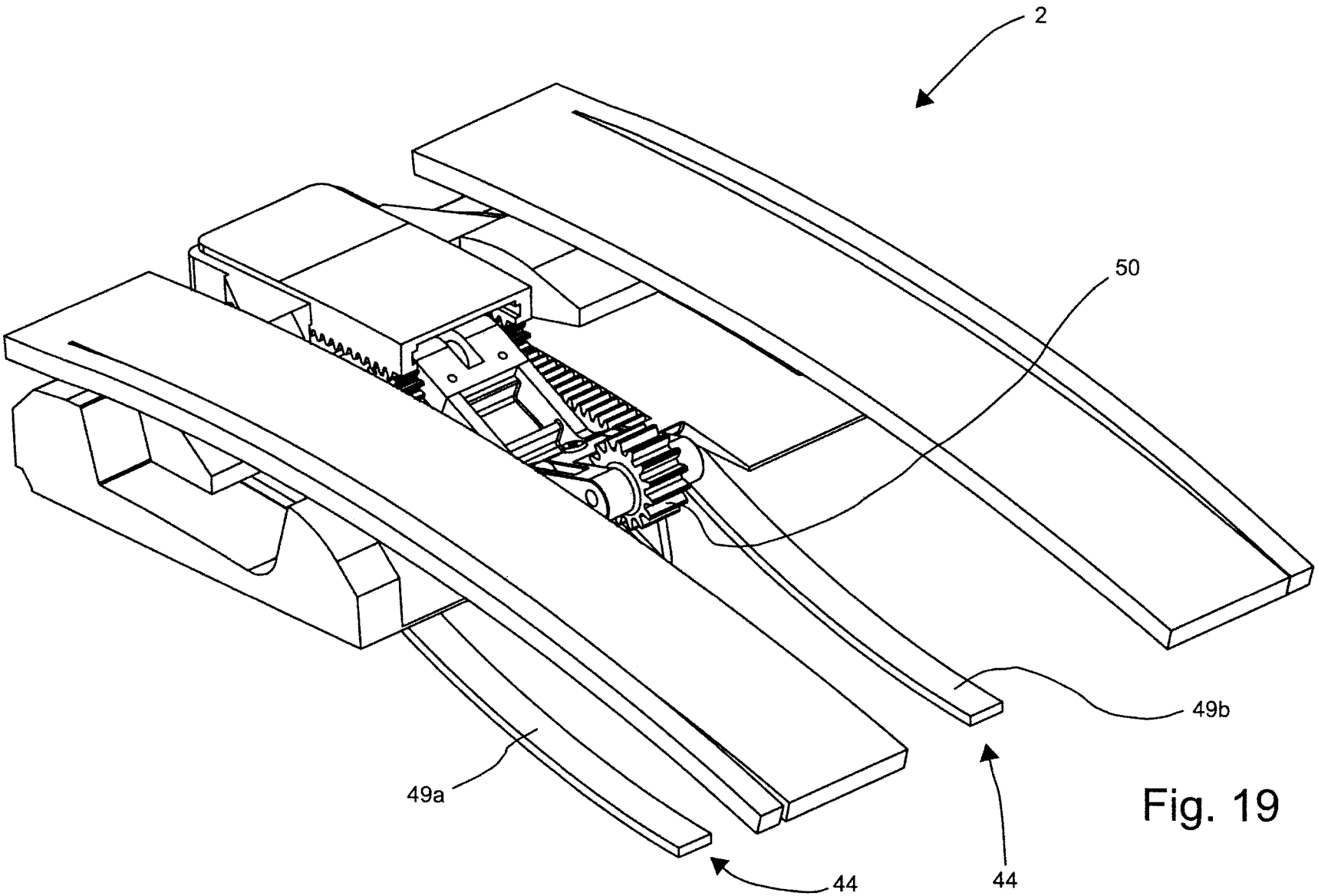

The support 6 is indirectly connected to the foot element 3, wherein the mechanical assembly 2 in addition to the support 6 further comprises a flange 42 (see FIG. 18), an articulation means 43 (see FIG. 9), and a weighing means 44 (see FIG. 19). The flange 42 here is connected to the foot element 3. The support 6 here by way of the articulation means 43 is articulated on the flange 42, and the support 6 here by way of the weighing means 44 is supported on the flange 42 (see FIG. 9). The articulation means 43 is configured as a four-point articulation having four articulation axes GLA-1 to GLA-4, this enabling the support 6 to be lowered when stressed by a person sitting down. The support 6 herein sinks down so far until the stress on the former is compensated for by the weighing means 44 which is formed by the further leaf springs or weighing springs 49*a*, 49*b*, respectively (see also FIG. 19). As soon as the person stands up again, the weighing springs 49*a*, 49*b* raise the support 6 again.

The adjustment mechanism 35 comprises a mechanical weighing action 45 and a mechanical adjustment action 46, wherein the mechanical weighing action 45 drives the mechanical adjustment action 46 depending on the body weight G of a person seated on the seat element 5, and the displaceable bearings 33, 34, depending on the body weight G of the person seated, are simultaneously displaced by the mechanical adjustment action 46 by identical paths W33, W34 along their raceways 36, 37 in such a manner that the seat shell S is supported by way of the rear swing arm 8 on the support 6 to a degree so as to correspond to the body weight G of the person (see in particular also FIG. 18). To this end, the mechanical adjustment action 46 which is driven by the mechanical weighing action 45 comprises a first transmission 47 having a first reduction gearing or positive gearing, and a second transmission 48 having a second reduction gearing or positive gearing. According to the variant of embodiment illustrated, the first and the second transmission 47, 48 are configured with the identical gear ratio, or the identical reduction gearing or the identical positive gearing, respectively. To this end, reference is made in particular to FIG. 18 and to FIGS. 12 to 14 which show the various positions.

With respect to the fundamental function of a weighing mechanism, in which an adjustment of the restoring force by which the chair counteracts the movements of the person—such as leaning back, for example—is performed by way of the body weight of a person seated on the chair, reference is made in principle to WO 2007/110732 A2 which has already been referred to in the introduction to the description.

Figure 12:
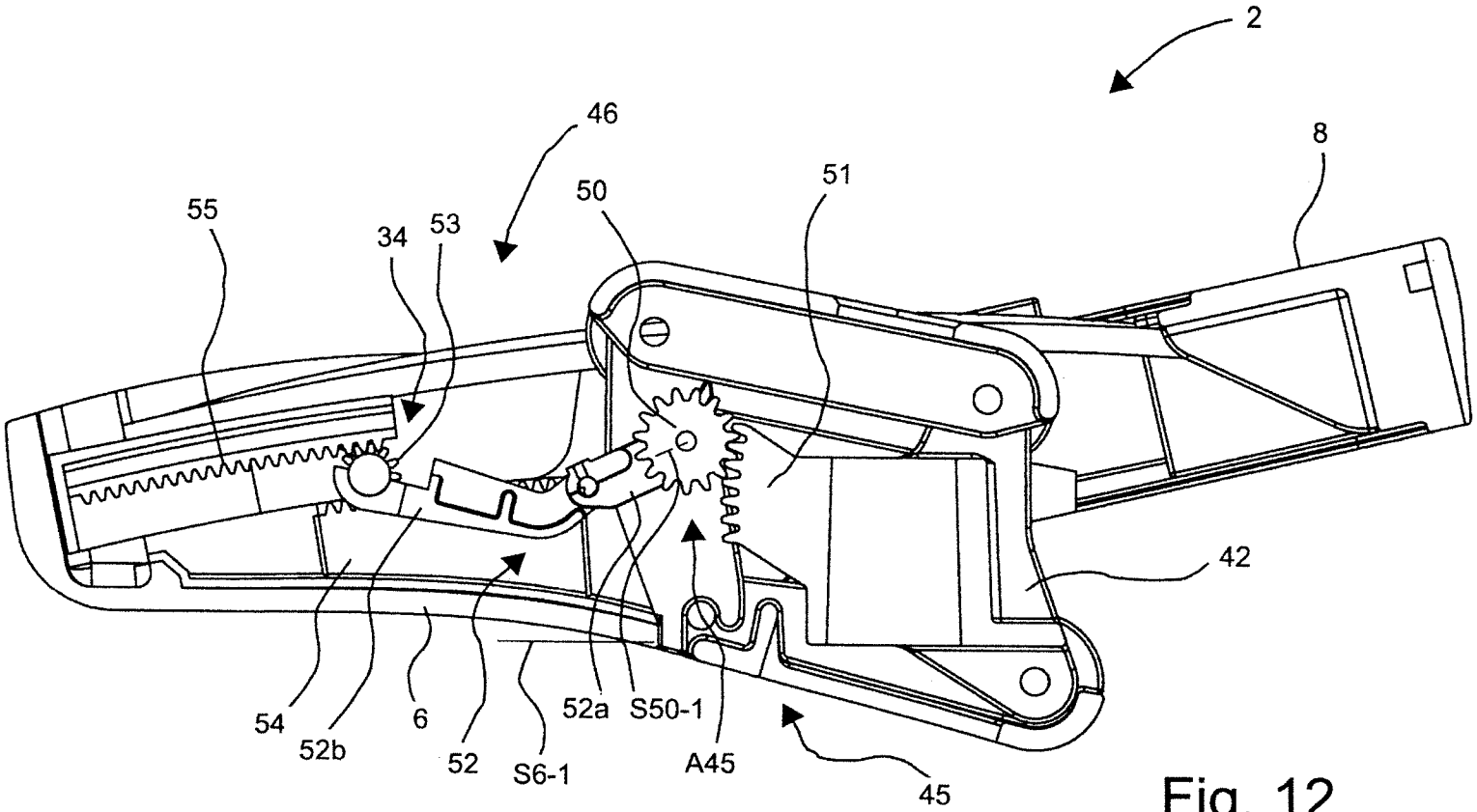
FIGS. 12 to 14 show sectional side views of the mechanical assembly in the unstressed, lightly stressed, and heavily stressed position of the support, respectively.
Figure 13:
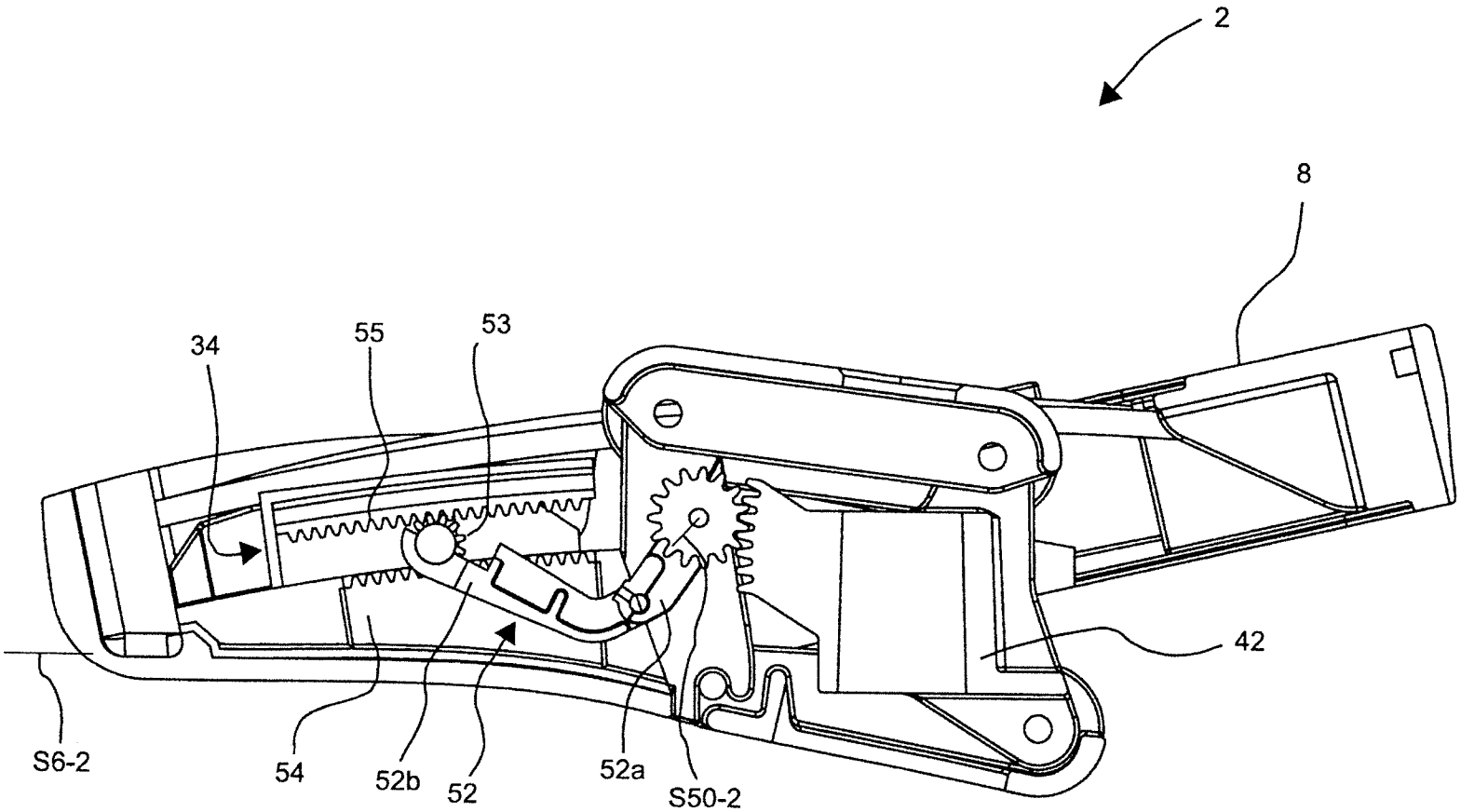
Figure 14:
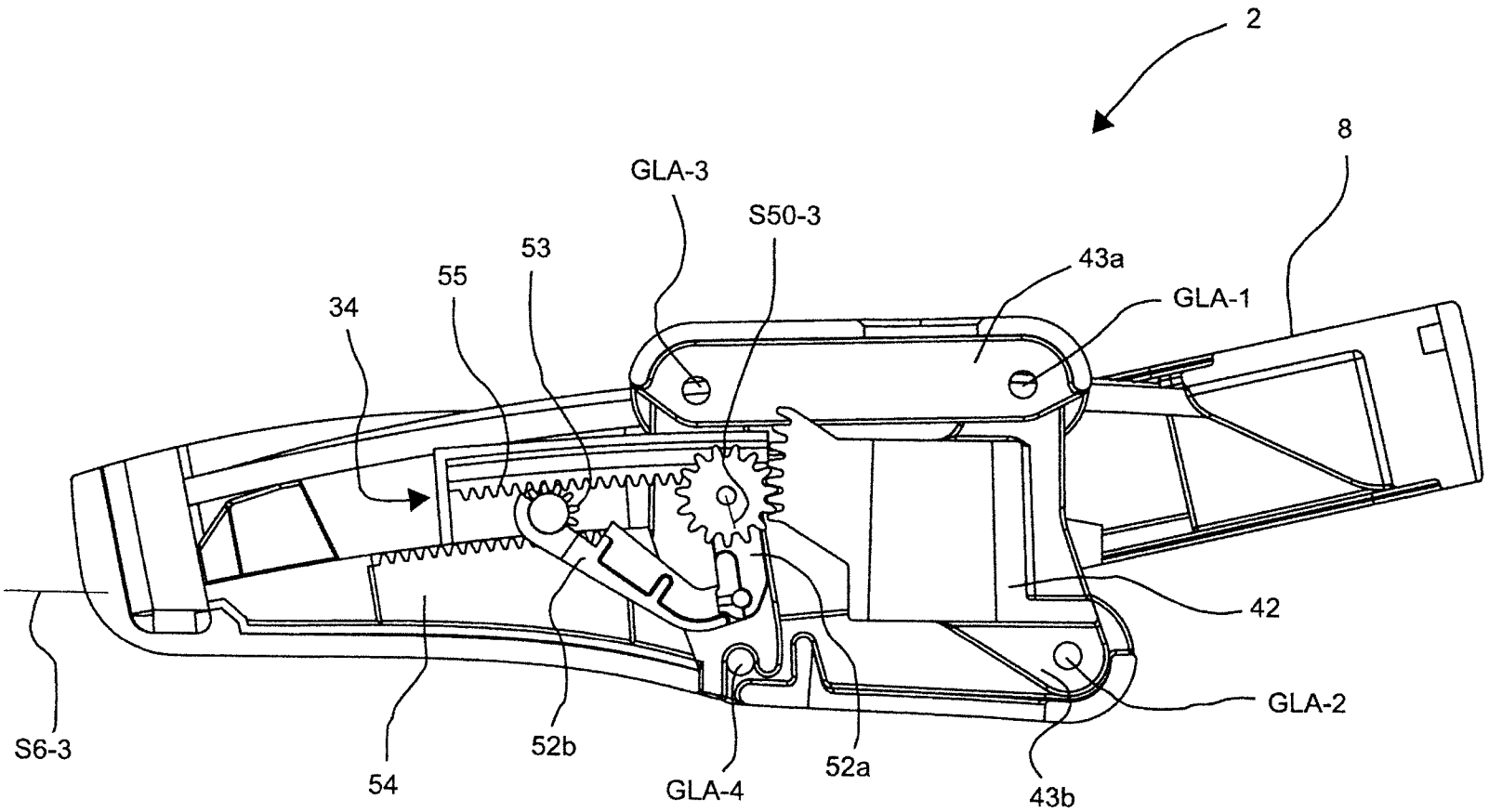
Figure 15:
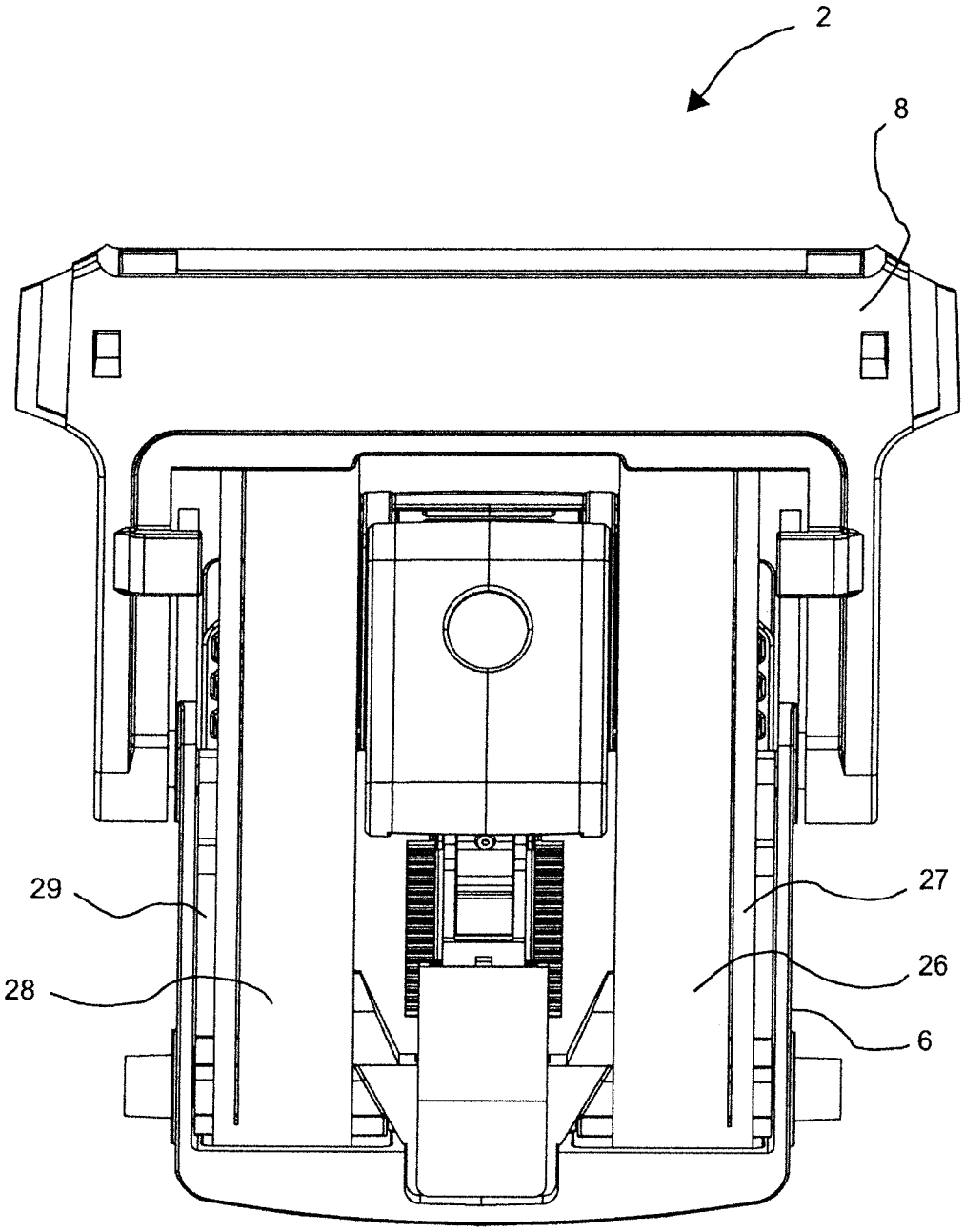
FIG. 15 shows a plan view of the mechanical assembly.
Figure 16:
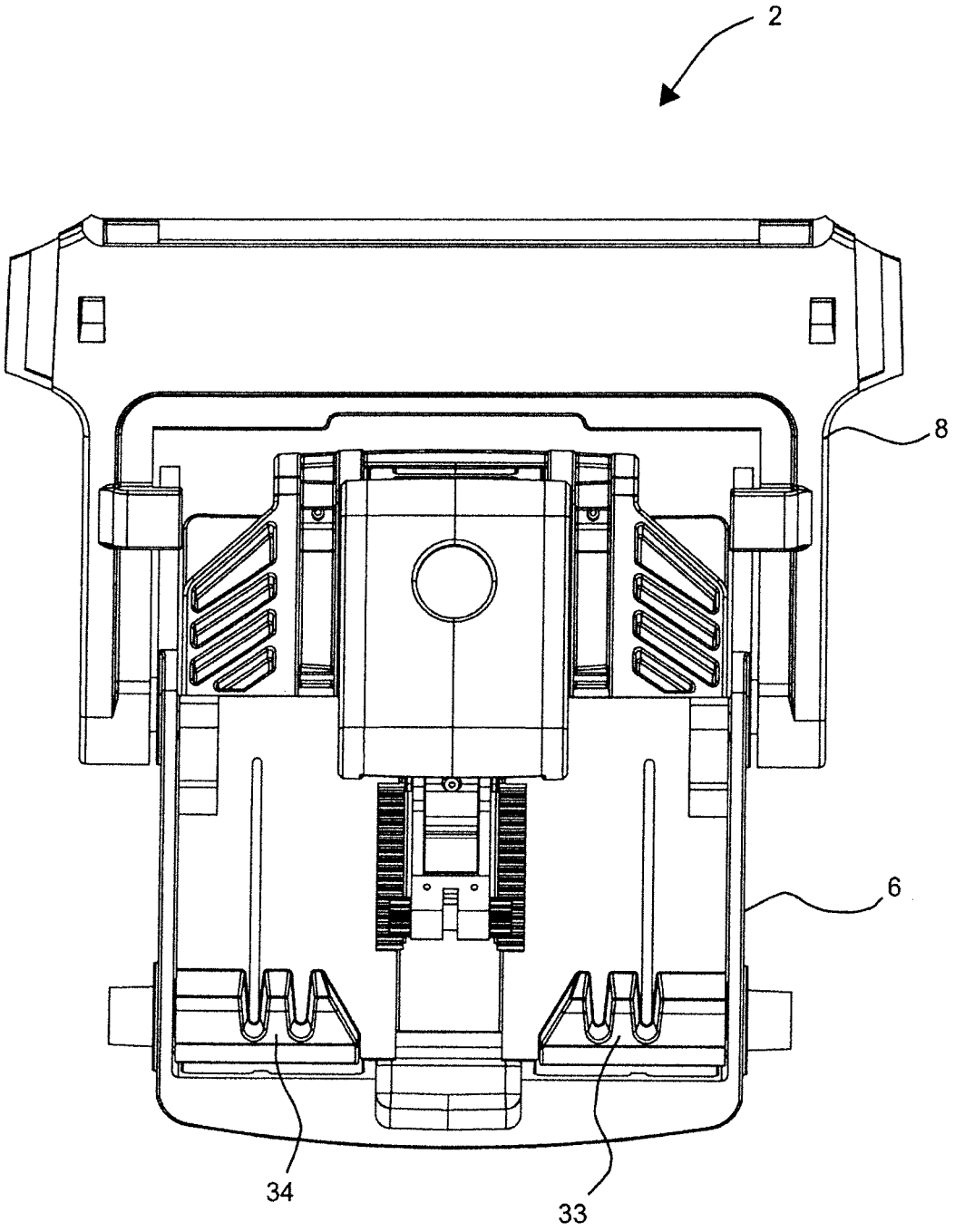
FIG. 16 shows a plan view of the illustration of FIG. 15, with the leaf springs removed.

FIG. 12 shows a longitudinal section through the mechanical assembly 2, wherein the flange 42 which is fixed onto the foot element 3 is identifiable. By way of the weighing means 44 which is visible in FIGS. 9 and 19, respectively, and which is configured by the two further leaf springs 49*a*, 49*b*, the support 6, by which the seat shell S (not illustrated) is supported, is held in the unstressed position S6-1 which is shown in FIG. 12. Here, a gear wheel 50 of the mechanical adjustment action 46, which is rotatably mounted on the support 6, meshes with a rack 51 which is configured on the flange 42, together with the latter forming a drive A45 for the transmissions 47, 48. In the event of light stress acting on the seat element 5 or the seat shell S, respectively, the support 6, counter to the spring force of the leaf springs 49*a*, 49*b*, is lowered in relation to the flange 42 into the position S6-2 which is shown in FIG. 13. During lowering, the gear wheel 50 is driven by the rack 51 and rotates in an anticlockwise manner from a first rotary position S50-1 (see FIG. 12) to a second rotary position S50-2 (see FIG. 13). By way of an articulated lever 52 or a knuckle joint lever, respectively, the first leg 52*a* of which is rigidly connected to the gear wheel 50 and the second leg 52*b* of which is connected in a rotationally articulated manner to the first leg 52*a*, and the second leg 52*b* of which at its free end rotatably supports a further gear wheel 53, the left-hand rotation of the first gear wheel 50 forces the articulated lever 52 to slightly buckle. As this buckling takes place, the second gear wheel 53, which runs between a further rack 54 which is configured on the support 6 and a rack 55 which is configured on the displaceable bearing 34, rolls on the lower rack 54. Here, on account of its right-hand rotation and its change of position, the second gear wheel 53 moves the third rack 55 and thus the bearing 34 to the right in the direction of the flange 42, such that the leaf spring 28 which is assigned to the bearing 34 is subject to increasing support and, on account thereof, exerts a greater restoring force on the rear swing arm 8. In FIG. 14, the body weight acting on the seat element 5 or the seat shell S, respectively, is even greater, and the support 6 in relation to the flange 42 is lowered to the position S6-3, such that the bearing 34 is moved farther in the direction of the flange 42.

The second transmission 48 mentioned thus comprises the articulated lever 52, the second gear wheel 53, and the racks 54 and 55. As can be seen from FIG. 20, the first gear wheel 50 drives the articulated levers of both transmissions and is thus a component part of both transmissions. Deviating from the illustrations of FIGS. 1 to 19, different gear ratios or reduction gearings or positive gearings, respectively, of the transmissions can be implemented by differently conceived articulated levers that move independently of one another and/or by a different layout of the units that are formed by the respective second gear wheel, the associated rack, and the associated bearing.

The first transmission 47 (not illustrated in more detail) again comprises all the components mentioned, such that also the other bearing 33 is movable, depending on the rack 51 configured on the flange 42 and depending on the thus caused rotation movement of the gear wheel 50. Here, the first transmission which moves the bearing 33, and the second transmission which moves the bearing 34, have identical gear ratios or reduction gearings or positive gearings, respectively, and, on account thereof, move the bearings 33, 34 in a synchronous manner, or by identical paths W33, W34 in the same periods of time, respectively.

As has been mentioned, in FIG. 14 the support 6 is shown in the heavily stressed position S6-3, in which the gear wheel 50 is in a rotary position S50-3. Accordingly, in this rotary position S50-3, the bearing 34 is then also displaced even farther toward the right in the direction of the flange 42, such that the leaf spring 28 exerts an even higher restoring force on the rear swing arm 8. The support 6 is guided on the flange 42 by way of the articulation means 43, these being implemented as two levers 43*a*, 43*b* which operate in parallel.

It can be seen from FIG. 17, for example, that the wide leaf spring 26 and the narrow leaf spring 27, and the wide leaf spring 28 and the narrow leaf spring 29, that is to say in each case an additional leaf spring with an adjustable leaf spring, in their first end regions 26*a*, 27*a*, and 28*a*, 29*a*, respectively, are in each case interconnected to form finger springs 56, 57, and outside their first end region 26*a*, 27*a*, and 28*a*, 29*a*, respectively, namely in a central region 26*d*, 27*d*, and 28*d*, 29*d*, respectively, and an opposite end region 26*c*, 27*c*, and 28*c*, 29*c*, respectively, are in each case separated by a slot 56*a* and 57*a*, respectively.

The support 6, conjointly with the leaf springs 26, 27, 28, and 29, and the fixed bearings 31, 32, and the displaceable bearings 33, 34, forms a spring mechanism FM1. The displaceable bearings 33, 34 are moved by a weight-controlled adjustment installation VE1 (cf. in particular FIGS. 17, 18). The adjustment installation VE1 comprises an actuator SG1, a transmission means UEM1, and the weighing mechanism 45 that guides the actuator SG1. The actuator SG1 herein is formed by the first gear wheel 50, and the transmission means UEM1 herein comprises the articulated lever 52, the second gear wheel 53, and the rack 55.

Figure 22:
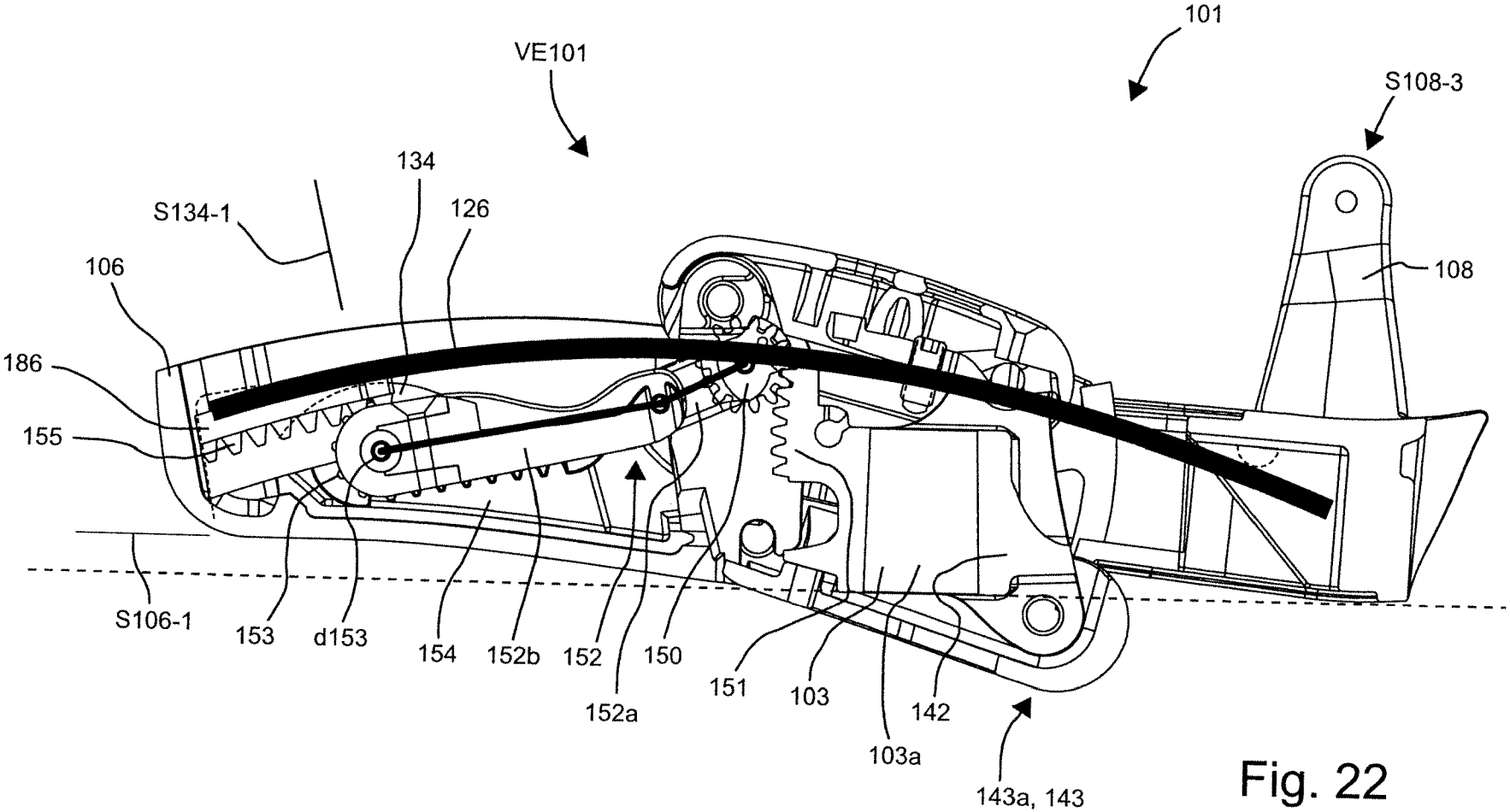
FIGS. 22, 23, 24 show sectional side views of a variant of embodiment of a chair according to the invention, with partially disregarded components, in various positions.
Figure 23:
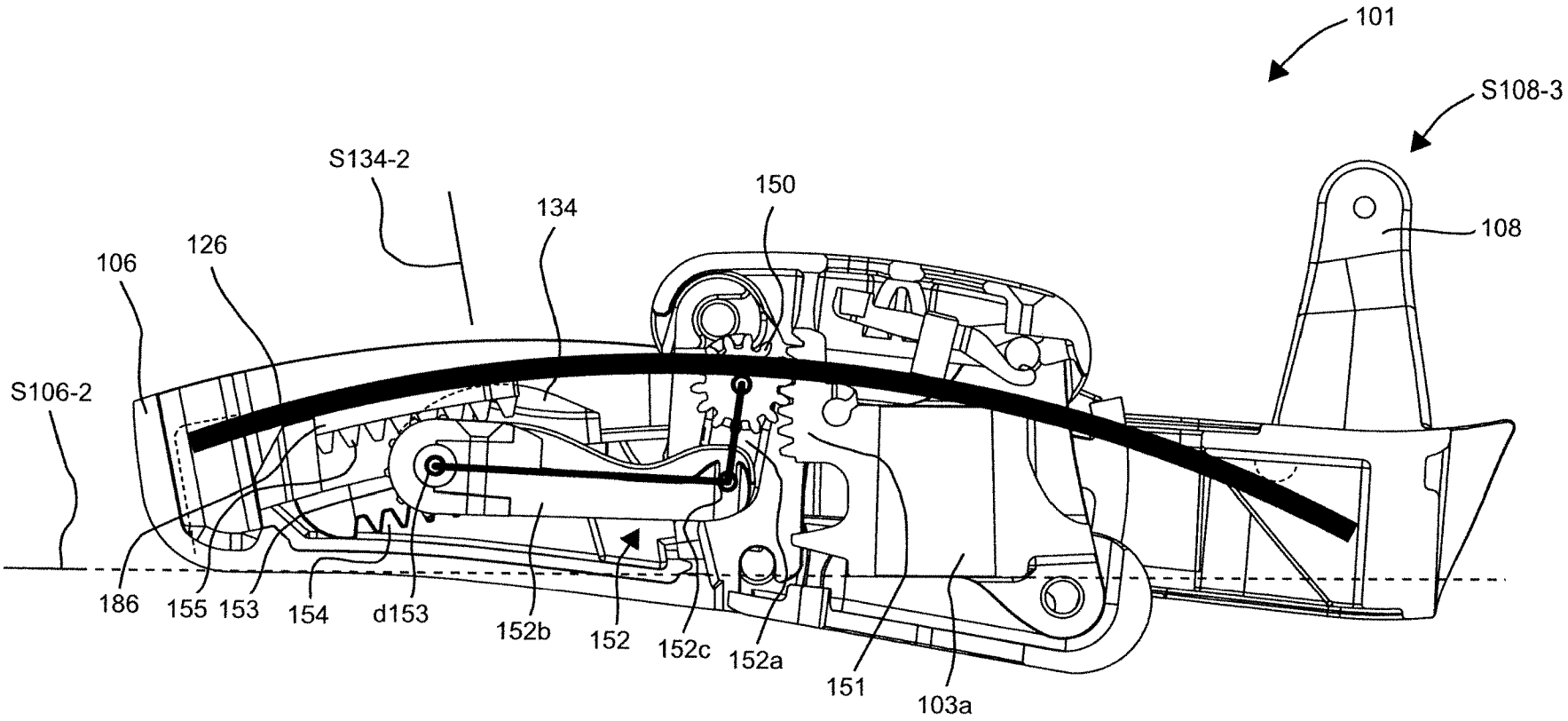
Figure 24:
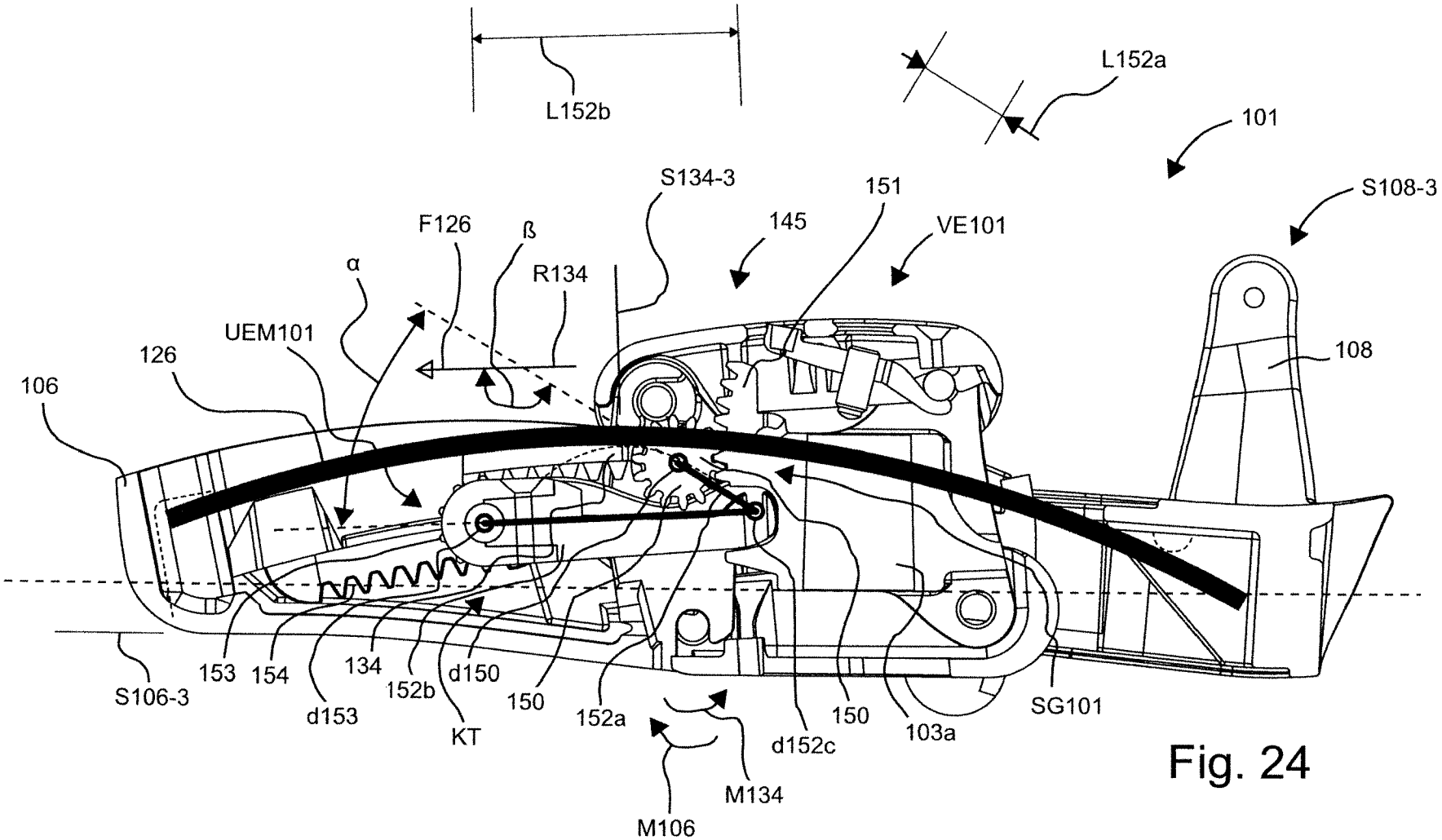

FIGS. 22-24 illustrate another version of an adjustment installation VE101 in the same the fundamental chair 1 construction from FIGS. 1-21. The components of the chair 101 that are not illustrated in FIGS. 22 to 24 are listed in a manner corresponding to the components of the chair 1 that are listed in FIGS. 1 to 21, wherein reference is explicitly made to the description pertaining to FIGS. 1 to 21.

When viewed in a comparative manner, it can be fundamentally seen in FIGS. 22 to 24 how a support 106 under a variable weight load in relation to a head piece 103*a* sinks in relation to a foot element 103 of which only the head piece 103*a*, or a flange 142, respectively, is illustrated. The head piece 103*a* of the foot element 103 and the support 106 are connected by way of an articulation means 143 that is configured as a parallelogram articulation 143*a*.

In FIG. 22, a seat element (not illustrated) and thus also the support 106 are not stressed or stressed only by a very light person. Accordingly, a bearing 134 is in a forward position S134-1, and the support 106 is in an upper position S106-1.

In FIG. 23, the seat element (not illustrated) and thus also the support 106 are stressed by a person of medium weight. Accordingly, the support 106 has sunk lower in relation to the head piece 103*a* of the foot element 103 as compared to the unstressed position S106-1 shown in FIG. 21, said support 106 being in a central position S106-2. Accordingly, the bearing 134 is also in a central position S134-2 below a leaf spring 126 that is assigned to the bearing 134. In the sinking of the support 106 (cf. FIGS. 22 and 23) a gear wheel 150 rolls on a rack 151 that is configured on the head piece 103*a*, said gear wheel 150 herein rotating toward the left. The gear wheel 150 herein also moves a first leg 152*a* of a knuckle joint lever, or of an articulated lever 152, respectively, to the left, said first leg 152*a* being connected in a rotationally fixed manner to the gear wheel 150, such that said knuckle joint lever or articulated lever 152 entrains toward the right a second leg 152*b* to which the first leg 152*a* in an articulation point 152*c* is connected in a rotationally articulated manner. Both legs of the articulated lever 152 in an idealized manner are also plotted as thick lines in FIGS. 22 to 24.

A second gear wheel 153 is connected to the second leg 152*b* at a free end of the latter, so as to be rotatable about a rotation axis d153. This second gear wheel 153 on a rack 154 that is connected to the support 106 rolls toward the right when the second leg 152*b* is pulled toward the right by the first leg 152*a*. The bearing 134 is disposed so as to be opposite the rack 154, wherein said bearing 134 comprises, on a lower side of a web 186 which is a component part of the bearing (cf. also FIG. 18), a denticulation similar to a rack, or a rack 155, respectively, by way of which said bearing 134 bears on the second gear wheel 153 such that the bearing 134, by the second gear wheel 153 that is moved toward the right and is thus rotated toward the right, is likewise moved toward the right.

The first gear wheel 150 in FIG. 24, on account of the support 106 being fully stressed, has then rolled even further on the rack 151 of the head piece 103*a*. Accordingly, the bearing 134 has thus also moved further toward the right to a third, rearward position S134-3 which is assumed by said bearing 134 when a heavy person sits on the chair 101. Accordingly, the support 106 in this instance has also sunk to the lowest position S106-3 thereof.

A rear swing arm 108 is also visible in each case in all three FIGS. 22, 23, and 24, wherein said swing arm 108 is in each case in a position S108-3 which is assumed by said rear swing arm 108 when a back element (not shown), or the seat shell (not shown), respectively, is completely tilted back by a person sitting on the chair 101, said back element or seat shell, respectively, thus being supported by way of a maximum force on the leaf spring 126, or on all the leaf springs that are installed for support. It can be seen in FIGS. 23 and 24 that heavy flexing of the leaf spring 126 is initiated by the tilting back of the back element when stressing the chair 101 by way of a person of medium or heavy weight. If the bearing 134 is in the rearward position S134-3 thereof (cf. FIG. 24), the leaf spring 126 acts on the bearing 134 by way of a force F126, wherein the force F126 strives to slide the bearing 134 toward the left. Accordingly, the second gear wheel 153 which is supported on the rack 154 of the support 106 strives to rotate toward the left and to pull the second leg 152*b* toward the left. The second leg 152*b* in turn, by means of the first leg 152*a* strives to rotate the first gear wheel 150 toward the right. However, on account of the position of the legs 152*a*, 152*b*, a torque M134 about a rotation axis d150 of the first gear wheel 150 generated by the force F126 acting on the bearing 134 is smaller than a counter torque M106 which on account of the weight of the user bears on the first gear wheel 150 by way of the rack 151 which is a component part of a weighing mechanism 145.

The two legs 152*a*, 152*b* in the rearward, third position S134-3 of the bearing 134 conjointly enclose an angle $\alpha$ smaller than 40°. In order for the angle $\alpha$ to be measured, connection lines which run in the direction of the legs 152*a* and 152*b*, respectively, between a rotation axis d152*c* of the articulation point 152*c* and the rotation axis d150, or the rotation axis d153, respectively, are observed herein.

Furthermore, the first leg 152*a* in relation to a movement direction R134 of the bearing 134 is at an angle $\beta$ of greater than 130° when the bearing 134 is in the rearward, third position S134-3. The first leg 152*a* has a length L152*a*, and the second leg 152*b* has a length L152*b*. The length L152*b* of the second leg 152*b* herein is at least double the length L152*a* of the first leg 152*a*. On account of the embodiment of the first leg 152*a* that is short in comparison to the second leg 152*b*, a crank mechanism KT that comprises the two legs 152*a*, 152*b* measured in the vertical direction requires little installation space such that said crank mechanism KT can be installed in the flat support 106.

According to a variant of embodiment (not illustrated) it is also provided that the rack disposed on the support, the second gear wheel, and the denticulation disposed on the lower side of the bearing, are disposed with, and the second leg is connected directly to the bearing in a rotationally articulated manner. The bearing herein then slides on a raceway that is opposite the leaf spring.

The displaceable bearing 134 is moved by a weight-controlled adjustment installation VE101. The adjustment installation VE101 comprises an actuator SG101, a transmission means UEM101, and the weighing mechanism 145 that guides the actuator SG1. The actuator SG101 herein is formed by the first gear wheel 150, and the transmission means UEM1 herein comprises the articulated lever 152, the second gear wheel 153, and the rack 155.

LIST OF REFERENCE SIGNS

1 Chair
2 Mechanical assembly
3 Foot element
4 Back element
5 Seat element
6 Support
7 Front swing arm
8 Rear swing arm
9, 10 Axle journal on 6
11 H-type bracket formed by 7
12-15 Leg of 11
16 Cross brace
17, 18 Axle journal on 6
19 H-type bracket formed by 8
20-23 Leg of 19
24 Cross brace of 19
25 Appendage of 19
26 Wide internal leaf spring
26*b* Lower side of 26
27 Narrow external leaf spring
28 Wide internal leaf spring
28*b* Lower side of 26
29 Narrow external leaf spring
30 Base of 6
26*a*-29*a* First end region of 26-29
26*b*-29*b* Lower side of 26-29
26*c*-29*c* Second end region of 26-29
31, 32 Bearing for 27, 29 on 6
33, 34 Displaceable bearing
35 Adjustment mechanism
36, 37 Raceway for bearing 33 and 34, respectively
36*a* Curved face formed by 36
38 Bulkhead of 6
39 Receptacle on 6 for 26 to 29
40 Further spring element, formed by 27
41 Further spring element, formed by 29
42 Flange
43 Articulation means
43*a*, 43*b* First, second lever
44 Weighing means
45 Mechanical weighing action of 35
46 Mechanical adjustment action of 35
47 First transmission
48 Second transmission
49*a*, 49*b* Leaf spring/weighing spring, forming weighing means 44
50 Gear wheel of 46, bearing on 51
51 Rack on 42
52 Articulated lever
52*a*, 52*b* First, second leg
53 Second gear wheel on 52*b*
54 Rack on 6
55 Rack on 34
56 Finger spring from 26, 27
56*a* Slot of 56
57 Finger spring from 28, 29
57*a* Slot of 57
86 Web
87 Guide of 33
88 Guide of 34
A45 Drive
D67 Pivot axis of 6, 7
D65 First pivot axis of 6, 5
D68 Pivot axis of 6, 8
D56 Second pivot axis of 6, 5
E33 Terminal position of 33
GLA-1 GLA-4 Articulated axis of 43
SFR6 Right side wall of the support
SFL6 Left side wall of the support G Body weight of a person
G33 Basic position of 33
S Seat shell
R26, R28 Restoring force of 26, 28
R33 Moving space of 33
R40, R41 Restoring force of 40, 41
RG Total restoring force
W33 Path of 33
W34 Path of 34
S6-1 Unstressed position of 6
S6-2 Lightly stressed position of 6
S6-3 Comparatively heavily stressed position
S50-1 First rotary position of 50
S50-2 Second rotary position of 50
S50-3 Third rotary position of 50
ML Central longitudinal axis
SE Mirror plane
FM1 Spring mechanism
VE1 Adjustment installation
UEM1 Transmission means
SG1 Actuator
101 Chair 101
103 Foot elements
103*a* Head piece 103*a*
106 Support 106
108 Rear swing arm 108
126 Leaf spring 126
134 Bearing 134
142 Flange 142
143 Articulation means 143 connected.
143*a* Parallelogram articulation 143*a*
145 Mechanical weighing action
150 Gear wheel 150
151 Rack 151
152 joint or articulated lever 152
152*a* First leg 152*a*
152*b* Second leg 152*b*
152*c* Articulation point 152*c*
153 Second gear wheel 153
154 Rack on 106 154
155 Rack 155
α Angle
β Angle
d150 Rotation axis of 150
d152*c* Rotation axis of 152*c*
d153 Rotation axis of 153
F126 Force
FM101 Spring mechanism
KT Crank mechanism
L152*a* Length of 152*a*
L152*b* Length of 152*b*
M106 Counter torque about d150
M134 Torque about d150
R134 Movement direction of 134
S106-1 First, upper position of 106
S106-2 Second, central position of 106
S106-3 Third, lowest position of 106
S108-3 Third position of 108
S134-1 First, forward position of 134
S134-2 Second, central position of 134
S134-3 Third, rearward position of 134
SG101 Actuator
UEM101 Transmission means
VE101 Adjustment installation

The invention claimed is:

1. A chair comprising a support, a seat element, a back element, a foot element, a spring mechanism, and a weight-control-operated adjustment installation for the spring mechanism, wherein the spring mechanism comprises at least one leaf spring that on one side is clamped in the support, and at least one bearing that is displaceable on a raceway between at least one of the leaf springs and the support, wherein the back element and/or the seat element are/is supported on a free end region of the at least one leaf spring, wherein the adjustment installation comprises an actuator, a transmission means, and a weighing mechanism that guides the actuator, characterized in that:

the actuator comprises a gear wheel, and the actuator in the stressing and the de-stressing of the seat element is displaced by the mechanical weighing action on a rack that is disposed in a locationally fixed manner on the foot element and herein rolls on said rack, wherein the transmission means comprises a knuckle joint lever, wherein the knuckle joint lever comprises a first leg and a second leg, wherein the first leg is connected in a rotationally fixed manner to the gear wheel, wherein the first leg and the second leg an articulation point are interconnected so as to be rotated in an articulated manner about an articulation axis, wherein the second leg is connected to the bearing, wherein the bearing, depending on a rotary position of the first gear wheel between a forward position and a rearward position, is positioned below the at least one leaf spring such that said leaf spring, depending on the respective position of the bearing, supports the back element to a variable degree.

2. The chair as claimed in claim 1, characterized in that the leaf spring in the case of a completely tilted-back back element by way of a force slides the bearing from the rearward position thereof in the direction of the forward position of said bearing such that by way of the first and of the second leg a torque acts on the first gear wheel of the actuator, wherein said torque, by way of a position of the legs assumed by the latter in the rearward position of the bearing, is kept low in such a manner that any rotation of the first gear wheel is prevented on account of the weight-controlled weighing mechanism.

3. The chair as claimed in claim 1, characterized in that the two legs in the rearward position of the bearing conjointly are at an angle $\alpha<30°$.

4. The chair as claimed in claim 1, characterized in that the first leg in the rearward position of the bearing is at an angle β of at least 130° in relation to a movement direction of the bearing.

5. The chair as claimed in claim 1, characterized in that the first leg is shorter than the second leg, and in that the first leg has a length which is at most half a length of the second leg.

6. The chair as claimed in claim 1, characterized in that the transmission means comprises a second gear wheel and a rack that is configured so as to be locationally fixed on the support, wherein the second gear wheel is connected to a free end of the second leg so as to be rotatable about a rotation axis, wherein the second gear wheel in a rotating movement of the first gear wheel rolls on the rack that is configured on the support, and wherein the second gear wheel is connected to the bearing in such a manner that said second gear wheel engages in a denticulation that is configured on the bearing such that the bearing in the rolling of the second gear wheel is displaced with the second gear wheel on the rack that is configured on the support displaced relative to the second gear wheel.

7. The chair as claimed in claim 1, characterized in that the chair comprises an articulation means and a weighing spring, wherein the foot element and the support are connected by the articulation means, and wherein the support is supported on the foot element by way of the weighing spring.

8. The chair as claimed in claim 1, characterized in that the back element and the seat element form a seat shell.

9. The chair as claimed in claim 8, characterized in that the chair comprises a front swing arm and a rear swing arm, wherein the front swing arm is pivotably articulated on the support and is connected to the seat element, wherein the rear swing arm is pivotably articulated on the support and is connected to the seat shell.

10. The chair as claimed in claim 8, characterized in that the leaf spring is fixed to the support by a first end region, bearing on the bearing outside the first end region, and supporting the seat shell outside the first end region.

* * * * *